US006781328B2

(12) United States Patent
Horiuchi et al.

(10) Patent No.: US 6,781,328 B2
(45) Date of Patent: Aug. 24, 2004

(54) IMAGE DISPLAY APPARATUS AND METHOD FOR OPERATING THE SAME AND LAMP UNIT FOR IMAGE DISPLAY APPARATUS

(75) Inventors: Makoto Horiuchi, Nara (JP); Tsuyoshi Ichibakase, Osaka (JP); Tomoyuki Seki, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/341,017

(22) Filed: Jan. 13, 2003

(65) Prior Publication Data

US 2003/0146718 A1 Aug. 7, 2003

(30) Foreign Application Priority Data

Jan. 15, 2002 (JP) ..... 2002-006695

(51) Int. Cl.[7] ..... H05B 41/36

(52) U.S. Cl. ..... 315/291; 315/224; 353/31

(58) Field of Search ..... 315/291, 224, 315/209 R, DIG. 7, 307; 353/31

(56) References Cited

U.S. PATENT DOCUMENTS

| | | | | | |
|---|---|---|---|---|---|
| 5,124,895 | A | * | 6/1992 | Segoshi et al. | 315/85 |
| 5,583,396 | A | * | 12/1996 | Hideaki et al. | 315/106 |
| 6,215,252 | B1 | * | 4/2001 | Stanton | 315/224 |
| 6,550,935 | B1 | * | 4/2003 | Ueno et al. | 362/263 |
| 6,597,118 | B2 | * | 7/2003 | Arimoto et al. | 315/115 |
| 2003/0015972 | A1 | * | 1/2003 | Suzuki | 315/291 |
| 2003/0090633 | A1 | * | 5/2003 | Miyata | 353/31 |

FOREIGN PATENT DOCUMENTS

| | | |
|---|---|---|
| JP | 3-22393 | 3/1991 |
| JP | 03136938 A | 6/1991 |
| WO | WO 00/77826 A1 | 12/2000 |

* cited by examiner

*Primary Examiner*—Wilson Lee
*Assistant Examiner*—Ephrem Alemu
(74) *Attorney, Agent, or Firm*—Harness, Dickey & Pierce, P.L.C.

(57) ABSTRACT

An image display apparatus includes a lamp unit including a discharge lamp and a reflecting mirror, an optical system and a ballast circuit. The ballast circuit includes a power circuit portion, an inverter portion and a start circuit portion. The start circuit portion of the ballast circuit is electrically connected to the discharge lamp and is separated from the power circuit portion and the inverter portion.

16 Claims, 14 Drawing Sheets

ON
Main body switch
t

ON
Ballast circuit
t

Operation time of start circuit
ON
Main system
t restart
ON
Main system
t

IMAGE DISPLAY APPARATUS AND METHOD FOR OPERATING THE SAME AND LAMP UNIT FOR IMAGE DISPLAY APPARATUS

BACKGROUND OF THE INVENTION

The present invention relates to an image display apparatus and a method for operating the same, and a lamp unit for an image display apparatus. In particular, the present invention relates to an image display apparatus, such as a liquid crystal projector, provided with a lamp unit including a high-pressure mercury lamp or a metal halide lamp and a discharge lamp ballast circuit for operating the lamp, and a method for operating the same.

Image display apparatuses such as liquid crystal projector devices are known as means for projecting magnified images of characters, graphics and the like and displaying them. Since such image display apparatuses (or image projection apparatuses) require a predetermined optical output, high-pressure mercury lamps with high brightness are, in general, used widely as light sources. Moreover, as projectors become widespread, there is a growing demand for a brighter and smaller projector.

FIG. 10 schematically shows a cross-sectional structure of a conventional lamp unit 1000 having a high-pressure discharge lamp 101 used for projectors.

The high-pressure discharge lamp 101 shown in FIG. 10 is a high-pressure mercury lamp of alternating current operation type that operates with alternating current. A sealed portion of the lamp 101 is inserted into a neck 1011*a* of a reflecting mirror 1011, where it is secured with cement and the like. This lamp 101 provided with the reflecting mirror 1011 is housed in a lamp housing 1013, and thus the lamp unit 1000 is constituted.

A pin 311 that serves as a connector is provided in the lamp unit 1000, and the lamp 101 is connected to this pin 311 via cables (leads) 321. FIG. 11A is a perspective view schematically showing the lamp unit 1000, and FIG. 11B is a partially cutaway perspective view schematically showing a projector main body 1100 in which the lamp unit 1000 is to be set.

The lamp unit 1000 can be detached from the projector main body 1100, as shown in FIG. 11B. To achieve such a removable structure, a plug 310 corresponding to the pin 311 provided in the lamp unit 1000 is provided in the main body 1100, and the pin 311 is provided in the lamp unit 1000. The plug 310 and the pin 311 are interchangeable, and the pin can be provided in the main body 1100 and the plug can be provided in the lamp unit 1000.

When the lamp unit 1000 is set in the main body 1100, the pin 311 is coupled to the plug 310. The plug 310 is electrically connected to a ballast circuit (not shown) provided in the main body 1100, and the ballast circuit starts and operates the lamp 101 in the lamp unit 1000. When the lamp unit 1000 is set in the main body 1100, a cooling fan 1104 is situated behind the lamp unit 1000 and a cover 1106 is mounted over the lamp unit 1000. Moreover, an optical system using the lamp 101 as a light source and a system (main system) for controlling the optical system to display images are provided in the main body 1100, and light emitted from the lamp 101 goes through the optical system and a projection lens 1105 to be projected on a screen, where an image is formed.

Next, the circuit structure of a ballast circuit 102 provided in the main body 1100 will be described with reference to FIGS. 12 through 14.

As shown in FIG. 12, the ballast circuit 102 for starting and operating the lamp 101 includes a direct current power 103, a full-bridge inverter circuit 104, which is an inverter circuit, and a start circuit 105. As described above, the ballast circuit 102 is electrically connected to the plug 310 that is provided in the main body 1100 side, and the plug 310 is connected to the full-bridge inverter circuit 104 and the start circuit 105 with high withstand voltage cables 320.

When the lamp unit 1000 is set, the pin 311 is inserted in the plug 310, and the lamp 101 is connected to the pin 311 via the cables 321. The lamp 101 is designed such that the lamp voltage during operation is lower than the maximum output voltage of the direct current power 103. For example, in the case where the maximum output voltage of the direct current power 103 is about 370V, the maximum lamp voltage is about 50V to 250V.

The direct current power 103 is constituted by a step-down chopper circuit that outputs, for example, direct current of a maximum of about 370V in response to an input of direct current of about 370V. The step-down chopper circuit includes a control circuit 115 and a switching element (e.g., transistor, FET, or GTIB) 108. The step-down chopper circuit detects an output voltage with resistors 112 and 113 and an output current with a resister 114, calculates two detection signals with the control circuit 115, and controls on-off of the switching element 108 by an output signal of the control circuit 115 such that the output power of the step-down chopper circuit becomes a predetermined value. Usually, an electrolytic capacitor 111 for smoothing voltage having a relatively large capacitance is connected in parallel to the output terminals of the direct current power 103. In the case where alternating current is input, a rectifying and smoothing circuit for rectifying and smoothing the alternating current input and converting it to direct current is added in a previous stage of the step-down chopper circuit.

The full-bridge inverter circuit 104 is constituted by transistors 117, 118, 119 and 120 and a drive circuit 121, as shown in FIG. 13. In the full-bridge inverter circuit 104, the transistors 117 and 120 and the transistors 118 and 119 are alternately turned on and off by output signals of the drive circuit 121, and thus the output of the step-down chopper circuit is converted to alternating current.

One terminal A of the full-bridge inverter circuit 104 is connected to one terminal TB of a secondary coil (output side coil) constituting the transformer of the start circuit 105 (see FIG. 14) described below, whereas the other terminal B is connected to one end of the lamp via the plug 310 and the pin 311. Moreover, a capacitor 300 is connected in parallel to the both output terminals of the inverter, and this capacitor 300 serves to bypass a high voltage pulse generated in the start circuit 105.

The start circuit 105 is a circuit that generates a high voltage pulse for starting the high-pressure mercury lamp 101. As shown in FIG. 14, the start circuit 105 includes a transformer 208, a resistor 201, a diode 205, a capacitor 206 and a discharge gap 207. Its input terminals are connected to the output terminals of the direct current power 103, and one terminal Tb of the output terminals is connected to the output terminal A of the inverter, and the other terminal Ta is connected to one end of the lamp 101 via the plug 310 and the pin 311, as described above.

The discharge gap 207 has the characteristics that it starts discharge at a voltage that is slightly lower than the output voltage of the direct current power 103 and is higher than the voltage of the lamp in operation (for example, about 350 V), and does not effect discharge (or stops discharge) at a voltage lower than that. Also, the discharge gap 207 has the characteristics that when a pulse voltage of about 350 V (peak value) is applied to a primary coil of the transformer 208, it outputs the high pulse voltage having a peak value of about 10 kV to 15 kV across both the terminals Ta and The of the secondary coil. In such a transformer 208 for generating a high voltage, the primary coil and the secondary coil are wound around cores (e.g., ferrite cores) having a high magnetization capability (not shown).

In addition to this, a timer circuit (not shown) is incorporated in the ballast circuit 102, and the timer circuit has the function of counting the time since the ballast circuit starts operating, and forcefully stopping the operation of the ballast circuit 102 when the lamp 101 fails to operate after a predetermined period (about 3 to 5 seconds). Furthermore, the ballast circuit 102 is also provided with a circuit (not shown) for outputting a signal to indicate the forced stop of the ballast circuit 102 when the lamp 101 did not operate as described above.

In the conventional ballast circuit 102, the direct current power 103, the full-bridge inverter 104, and the start circuit 105 are disposed on the same substrate. The output of this ballast circuit 102 goes through the high withstand voltage cable 320 having a length of about 20 cm to several tens cm and a withstand voltage of about 20 kV, and is supplied to the lamp 101 disposed in the lamp unit 1000 via the plug 310 and the pin 311. The pin 311 is connected to the lamp 101 using a high withstand voltage cable such as the cable 320 as well, and this high withstand voltage cable (321) is a high withstand voltage cable having a length of about 10 cm, which is relatively shorter than the cable 320, and a withstand voltage of about 20 kV.

When the lamp 101 is a discharge lamp of direct current operation type that operates with direct current, the inverter 104 is omitted.

Then, the operation of the ballast circuit 102 will be described.

(1) First, when a signal for starting operation is sent to the direct current power 103 and the full-bridge inverter 104 with a direct current voltage of about 370 V being applied to the direct current power 103, the direct current power (step-down chopper circuit) 103 and the full-bridge inverter 104 start operating.

(2) Then, at the same time, the output voltage (voltage of about 370 V) of the direct current power 103 is input to the start circuit 105.

(3) When the input of the above procedure (2) is performed, the capacitor 206 starts being charged via the resistor 201 and the diode 205.

(4) Then, when the charged voltage of the capacitor 206 reaches a voltage for starting discharge of the discharge gap 207 of about 350 V, the discharge gap 207 discharges, and at that moment, the energy that has been charged in the capacitor is supplied to the primary coil of the transformer 208 at once.

(5) When the energy in the capacitor 206 is discharged, the voltage at the capacitor 206 decreases instantaneously, so that discharge of the discharge gap 207 stops instantaneously.

(6) As a result, a pulse voltage having a peak value of about 370 V is applied to the primary coil of the transformer 208. Thus, a high pulse voltage having a peak value of about 5 kV to 15 kV is output to the secondary coil of the transformer 208, which is, in turn, applied to the lamp 101 via the high withstand voltage cable 320, the plug 310, the pin 311 and the high withstand voltage cable 321.

(7) On the other hand, the capacitor 206 at which the voltage has decreased starts being charged again by the direct current power 103. Therefore, as a result, the above-described operations (3) through (6) are repeated at an interval determined by the time constant of the resistor 201 and the capacitor 206.

(8) When breakdown occurs in the lamp 101 upon application of a pulse voltage and the lamp 101 starts discharge, then a predetermined power is supplied to the lamp 101 through the inverter 104 from the direct current power 103.

(9) This operation is performed by supplying a signal for a voltage that is divided by the resistor 112 and the resistor 113 to detect the lamp voltage and a signal generated by a voltage drop at the resistor 114 for detecting the lamp current to the control circuit 115 of the direct current power 103, processing these signals, and controlling the on-off interval of the switching element 108 such that a power to be supplied to a predetermined lamp becomes a predetermined value.

(10) When the lamp 101 starts operating (breakdown), the operation of the discharge gap 207 stops because the discharge gap 207 is selected such that it operates at a voltage that is slightly lower than the output voltage of the direct current power 103 and is higher than the voltage of the lamp 101 in operation. Therefore, during operation of the lamp, the operation of the start circuit 105 stops.

The ballast circuit 102 operates in this manner. When the lamp fails to operate even after a predetermined time (typically, for 3 seconds to 5 seconds) has passed since the ballast circuit 102 started operating, the ballast circuit forcefully stops its operation, and simultaneously outputs a signal indicating the fact that the lamp does not operate (ballast circuit forced stop). The fact that the lamp fails to operate can be determined easily by the fact that the voltage drop at the resistor 114 that detects the lamp current is less than a predetermined value.

A projector using the above-described conventional ballast circuit 102 and lamp unit 1000 (and lamp 101 housed therein) has the following problems.

First, it is disadvantageous in reducing the size of the projector. Hereinafter, this aspect will be further described.

As projectors become smaller, the size of the ballast circuit 102 is also required to be reduced. However, it is difficult to reduce the size of the transformer (208) in the start circuit 105, so that it is difficult to reduce the size of the entire ballast circuit. For reference purposes, illustrative sizes of the ballast circuit 102 and the start circuit 105 are described as follows. For a class of 100 to 150 W, the size of the ballast circuit 102 is approximately 250 cc, in which the size of the start circuit 105 occupies approximately 25 cc. For a class of 200 W or more, the size of the ballast circuit 102 is approximately 300 cc to 500 cc, in which the size of the start circuit 105 occupies approximately 40 cc. That is to say, about 10% of the space is used only for the first moment (about one second) at which the lamp 101 is lit up.

Since the transformer (208) is a component that basically generates a high voltage, it is impossible to reduce the size of the transformer itself because of the insulation problems. In other words, there is substantially no way other than physically increasing the dimensions to ensure the insulating properties. Therefore, even though the sizes of the other parts can be technically reduced by making them into chips, ICs or modules, the size of the transformer cannot be reduced. Thus, the transformer is an impediment to reduction in size of the ballast circuit 102.

In addition, as seen from FIG. 14, the secondary coil of the transformer 208 is connected in series to the lamp 101. The lamp power of the lamp 101 that is commonly used for the projector is 80 W to 300 W, and in the case where the lamp having the lamp power of 80 W to 300 W is operated, it can be estimated that a current of up to several A (several amperes) flows to the transformer during operation of the lamp. Therefore, it is necessary to use a winding that is thick enough to withstand it for the secondary coil, which makes it further difficult to reduce the size of the transformer 208 (the start circuit 105).

Second, the cost is high and the startability of the lamp is poor.

As shown in FIG. 12, when the start circuit 10S is formed on the ballast circuit substrate, the start circuit 105 may be apart from the lamp 101 by a considerable distance of up to about several tens cm. This is often the case, in particular, in large equipment such as a projection TV. Moreover, even in small projectors, the same problem may arise depending on how the ballast circuit 102 and the lamp 101 are arranged and how wires are provided between the ballast circuit 102 and the lamp 101. Such a problem causes the following disadvantages.

First, it is necessary to use an expensive high withstand voltage cable (cable 320 in FIG. 12) between the start circuit 105 and the lamp 101, and thus the cost is increased.

Next, with respect to the lamp 101, the higher the start voltage is, the higher probability of starting the lamp is. However, the voltage that can be applied to start the lamp is virtually restricted to the withstand voltage of this cable. That is to say, since the maximum withstand voltage of the high withstand voltage cable 320 is about 20 kV to about 30 kV, the voltage that can be applied to start the lamp is virtually restricted to this value. This is a bottleneck in improving the starting characteristics of the lamp.

Furthermore, when this high withstand voltage cable has a length of several tens cm, a start voltage may be attenuated therethrough because the start voltage has a pulse waveform, namely, a waveform rich in high frequency components. In fact, the inventors confirmed by experiment that the attenuation of as much as 1 kV to 2 kV was seen in a certain projector. It seems that this attenuation does not depend on the value of the pulse start voltage that is output from the start circuit 105, but depends on only the type and the length of the cable, and the way of wiring. Therefore, there is no specific means for effective improvement, so that this is a very large disadvantage.

Moreover, as can be guessed from the fact that the voltage is attenuated, the energy of the pulse that has been attenuated results in radiated noise from the cable or voltage leakage to other equipment provided close to the cable, and as a result, causes damage (physically and/or operationally) to the projector main body that is an aggregation of precise electronic equipment and devices. Noise is also generated from the discharge gap in addition to the coils in the start circuit, so that these components also serve as noise sources. The projectors are often used in connection with PCs, and therefore one must be also concerned about damage to the external equipment such as PCs.

Currently, in order to prevent such malfunctions of the projector main body or the external equipment such as PCs, an operation sequence of the projector main body is performed as shown in FIGS. 15A through 15C or FIGS. 15A, 15B and 15D.

The sequence is as follows. As shown in FIGS. 15A through 15D, when a main switch of the projector is turned on (FIG. 15A), first, the start circuit 105 of the ballast circuit 102 starts operating (FIG. 15B), and operation of the other systems in the projector (that is, the main system for projecting images) is stopped while the start circuit 105 is in operation (FIG. 15C), and then, the system is activated after the start circuit 105 stops its operation (FIG. 15C). The fact that the start circuit 105 stops its operation can be determined by detecting the ballast circuit forced stop signal that is to be sent from the ballast circuit 102 being not output.

Alternatively, when the system and the start circuit 105 start operating at the same time, the sequence may be as follows. As shown in FIG. 15D, the operation of the system is forcefully reset and re-activated after the start circuit 105 stops.

Since the operation of the system is delayed from the moment when the main switch is turned on in this manner, consumers often erroneously take this delay for malfunction. Thus, reduction in this system activation time is also required. In particular, for a projector using full digital devices such as DMD, which is especially susceptible to damage such as noise, the start-up time to start the system tends to be set to be delayed. For example, the system starts as long as about 5 seconds after the main switch is turned on. The slow activation of the system is a very large problem. The time of five seconds is a considerably long time from a viewpoint of human psychology, so that some consumers cannot wait for 5 seconds as they erroneously take this slow activation for malfunction, and turn the main switch on again and again. Therefore, this slow activation can be the problem that cannot be ignored, saying that this is only slow activation.

SUMMARY OF THE INVENTION

Therefore, with the foregoing in mind, it is a main object of the present invention to provide an image display apparatus whose size is reduced further. It is another object of the present invention to provide an image display apparatus whose activation time can be shortened and a method for operating the same.

An image display apparatus of the present invention includes a lamp unit including a discharge lamp and a reflecting mirror for reflecting light emitted from the discharge lamp; an optical system having the discharge lamp as a light source; and a ballast circuit for starting and operating the discharge lamp. The ballast circuit includes a power circuit portion, an inverter portion, and a start circuit portion, and the start circuit portion of the ballast circuit is electrically connected to the discharge lamp and is separated from the power circuit portion and the inverter portion.

In one preferable embodiment, the power circuit portion and the inverter portion are formed on a same substrate, and the start circuit portion is not disposed on the substrate and is disposed in a position (including a position in the lamp unit) that is closer to the lamp unit than to the substrate.

In one preferable embodiment, the lamp unit includes a lamp housing for housing the discharge lamp and the reflecting mirror. The lamp housing has a shield function. The start circuit portion is provided in the lamp housing having the shield function.

In one preferable embodiment, the lamp unit includes a first connector that is electrically connected to the discharge lamp and is coupled to a second connector electrically connected to at least one of the power circuit portion and the inverter portion. The start circuit portion is provided in the first connector.

It is preferable that a combination of the first connector and the second connector is a combination of an attachment plug and a receptacle.

In one preferable embodiment, the image display apparatus has a structure in which a lamp current supplied from the inverter portion does not flow through a transformer included in the start circuit portion.

In one preferable embodiment, the lamp unit includes the first connector that is electrically connected to the discharge lamp and is coupled to a second connector electrically connected to at least one of the power circuit portion and the inverter portion In addition to the first and the second connectors, the lamp unit includes a third connector that is electrically connected to the start circuit portion. The third connector is coupled to a fourth connector that is electrically connected to a power source.

In one preferable embodiment, the combination of the first connector and the second connector is a combination of an attachment plug and a receptacle. A combination of the third connector and the fourth connector is a combination of an attachment plug and a receptacle.

In one preferable embodiment, the discharge lamp is a high-pressure mercury lamp.

In one preferable embodiment, the image display apparatus includes a digital micromirror device (DMD) in the optical system.

A method for operating an image display apparatus of the present invention is a method for operating an image display apparatus including a lamp unit including a discharge lamp and a reflecting mirror for reflecting light emitted from the discharge lamp; a ballast circuit for starting and operating the discharge lamp; an optical system having the discharge lamp as a light source; and a system for controlling the optical system to display an image. The ballast circuit includes a start circuit portion electrically connected to the discharge lamp. The start circuit portion of the ballast circuit is activated when a power switch included in the image display apparatus is turned on. The system is activated within an operation time during which the start circuit portion is in operation, and a re-activation processing operation is not performed as an activation operation of the system after the operation time is over.

It is preferable that when the power switch is turned on, the start circuit portion of the ballast circuit and the system are activated substantially at the same time, and a time from the turn-on of the power switch to the activation of the system is within about one second.

In one preferable embodiment, the image display apparatus includes a digital micromirror device (DMD) in the optical system.

Another image display apparatus of the present invention includes a lamp unit including a discharge lamp and a reflecting mirror for reflecting light emitted from the discharge lamp; a ballast circuit for starting and operating the discharge lamp; an optical system having the discharge lamp as a light source; and a system for controlling the optical system to display an image. The ballast circuit includes a power circuit portion, an inverter portion, and a start circuit portion. The start circuit portion of the ballast circuit is electrically connected to the discharge lamp and is separated from the power circuit portion and the inverter portion. The start circuit portion of the ballast circuit is activated when a power switch included in the image display apparatus is turned on. The system is activated within an operation time of the start circuit portion, and a re-activation processing operation of the system is not performed as an activation operation of the system after the operation time is over.

A lamp unit of the present invention is a lamp unit used for an image display apparatus including an optical system and a system for controlling the optical system to display an image. The lamp unit includes a discharge lamp; a reflecting mirror for reflecting light emitted from the discharge lamp; and a lamp housing for housing the discharge lamp and the reflecting mirror. A start circuit portion included in a ballast circuit for starting and operating the discharge lamp is separated from a power circuit portion and an inverter portion included in the ballast circuit and is provided in the lamp housing.

In one preferable embodiment, the lamp unit includes a first connector that is electrically connected to the discharge lamp and has a structure that can be coupled to a second connector electrically connected to at least one of the power circuit portion and the inverter portion.

In one preferable embodiment, the start circuit portion outputs a high voltage pulse for starting the discharge lamp to the discharge lamp during operation of the system.

According to the image display apparatus of the present invention, the start circuit portion of the ballast circuit is separated from the power circuit portion and the inverter portion, so that the size of the apparatus can be reduced. When the start circuit portion is disposed in the position that is closer to the lamp unit than to the substrate on which the power circuit portion and the inverter portion are disposed, and in the lamp unit, then the distance between the start circuit and the lamp can be shortened, so that the attenuation of the start voltage can be decreased. As a result, the startability of the lamp can be improved. Moreover, when the start circuit portion is provided in the lamp housing having a shield function, noise from the start circuit portion can be shielded. Therefore, it is possible to activate the system even during operation of the start circuit portion, and consequently it is possible to speed up the activation of the system in the image display apparatus.

When the lamp current does not flow into the transformer included in the start circuit portion, it is possible to use a thin wire for the winding of the transformer, so that the size of the start circuit portion can be further reduced. Moreover, this structure makes it is possible to drive the transformer at high frequency, so that it is preferable in operating a discharge lamp (low start voltage lamp) having a cavity in the sealed portion.

Then, according to the operating method of the image display apparatus of the present invention, the system is activated during the operation time of the start circuit portion and, as the activation operation of the system, the re-activation processing operation is not performed after the above-mentioned operation time is over Thus, the activation time can be reduced. Even if DMD that is susceptible to damage, for example, due to noise, is included in the optical system, the system can be activated substantially upon input of the power switch. Therefore, the present invention provides an advantage especially to an image display apparatus including DMD.

DETAILED DESCRIPTION OF THE INVENTION

Figure 1:
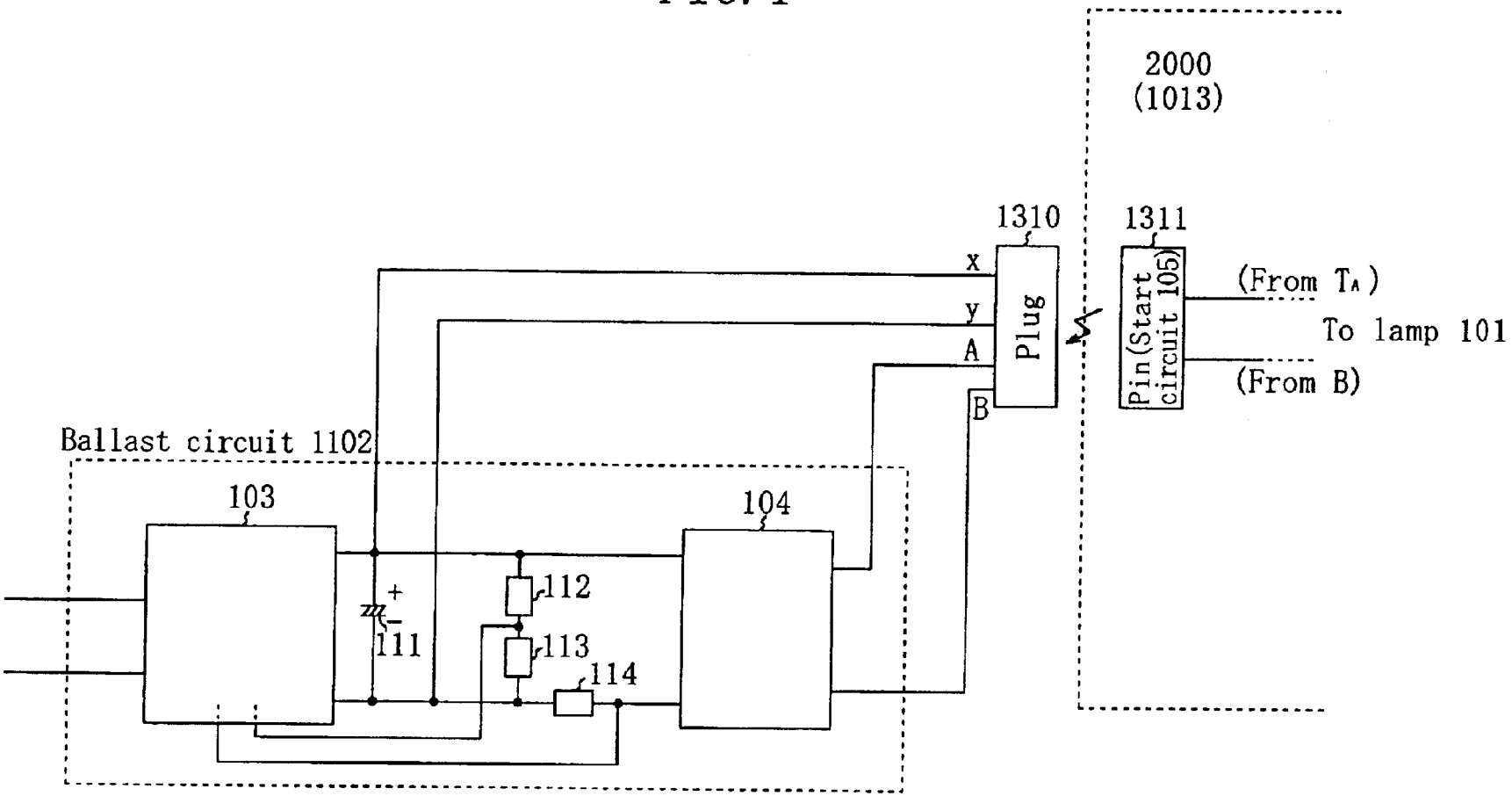
FIG. 1 is a diagram showing a circuit structure of a ballast circuit included in an image display apparatus of Embodiment 1 of the present invention.

Hereinafter, embodiments of the present invention will be described with reference to the accompanying drawings. In the following drawings, the components having substantially the same function bear the same reference numeral for simplification of description. Moreover, for ease of understanding, the components substantially corresponding to the components shown in FIGS. 10 through 14 bear the same reference numeral for convenience. However, the present invention is not limited to the following embodiments.

Embodiment 1

An image display apparatus of Embodiment 1 of the present invention will be described with reference to FIGS. 1 through 4.

FIG. 1 shows a circuit structure of a ballast circuit 1102 included in the image display apparatus of this embodiment. This circuit structure corresponds to the circuit structure of the ballast circuit 102 shown in FIG. 12 as described above.

The ballast circuit 1102 shown in FIG. 1 is a circuit for starting and operating a discharge lamp 101, and includes a power portion 103, an inverter portion 104, and a start circuit portion (igniter portion) 105. However, unlike the structure shown in FIG. 12, the start circuit portion 105 of the ballast circuit 1102 of this embodiment is separated from the power circuit portion 103 and the inverter portion 104 and provided in a housing 1013 of a lamp unit 2000. That is to say, the power portion 103 and the inverter portion 104 are formed on the same substrate, whereas the start circuit portion 105 is not formed on that substrate but provided in a position that is closer to the lamp unit 2000 than to the substrate.

In this embodiment, the start circuit 105 is separated from the substrate of the ballast circuit 1102 and housed in the lamp unit 2000. Furthermore, in the example of the structure shown in FIG. 1, the start circuit 105 is provided in a connector 1311, and the start circuit 105 also serves as a connector. The connector 1311 is electrically connected to the discharge lamp 101, and can be coupled to a connector 1310 that is electrically connected to at least one of the power circuit portion 103 and the inverter portion 104. It is preferable that the lamp unit 2000 can be detached from the projector main body and is replaceable, and therefore it is desirable that the connector 1311 and the connector 1310 have structures that are detachable and attachable to each other. In this embodiment, as a combination of the connector 1311 and the connector 1310, a combination of an attachment plug (also referred to as a "pin") and a receptacle (also simply referred to as a "plug") is adopted. In the example shown in FIG. 1, the connector 1310 is a plug and the connector 1311 is a pin. Alternatively, the connector 1310 can be a pin and the connector 1311 can be a plug.

For the power circuit portion 103 and the inverter portion 104, those that are known can be used. For the power circuit portion 103, a power circuit portion constituted by the step-down chopper circuit shown in FIG. 12 can be used, for example. For the inverter portion 104, an inverter portion constituted by the full-bridge inverter circuit shown in FIGS. 12 and 13 can be used.

Figure 12:
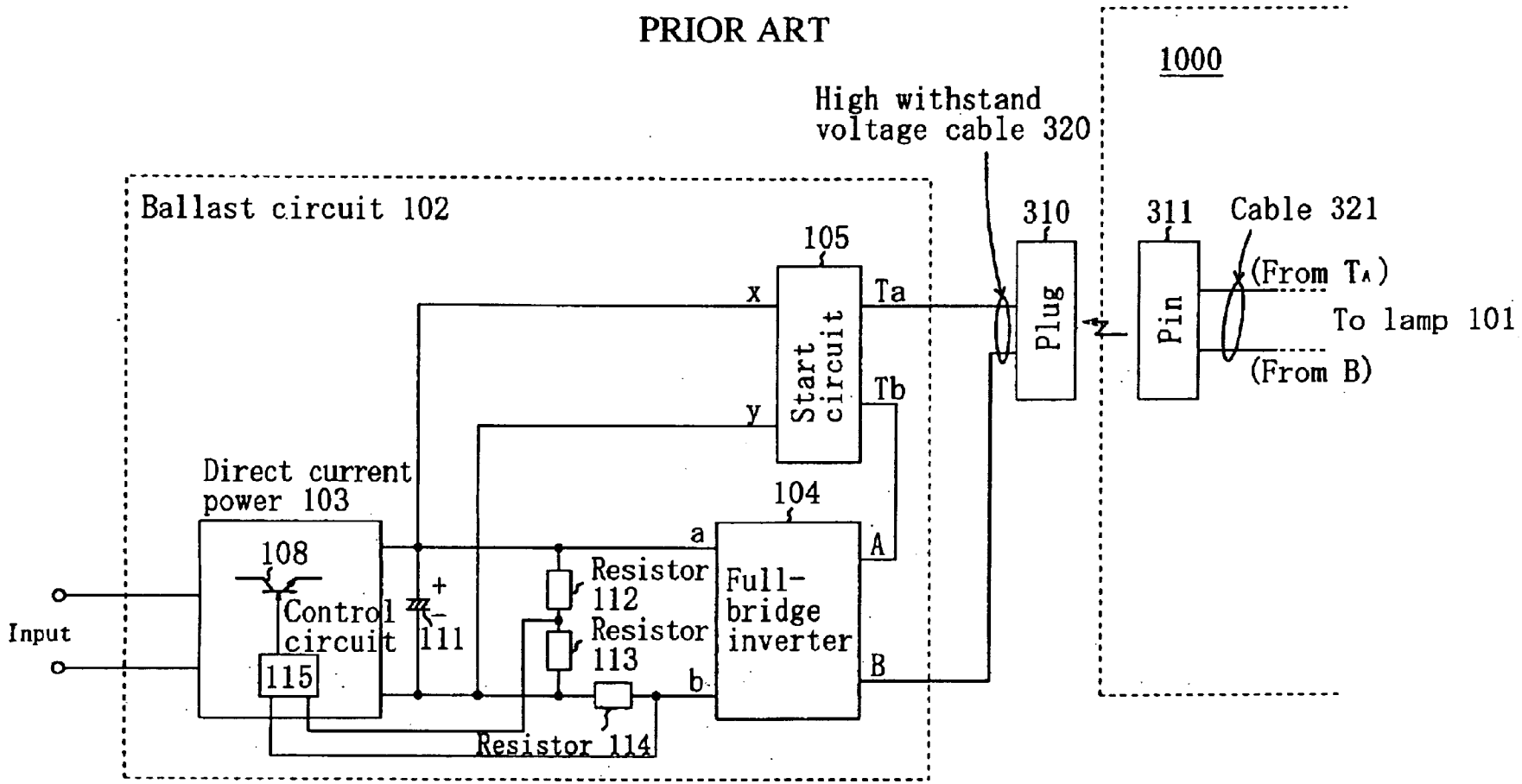
FIG. 12 PRIOR ART
FIG. 12 is a diagram showing a circuit structure of a conventional ballast circuit.

As described above, the step-down chopper circuit constituting the power circuit portion 103 can output, for example, a direct current of up to about 370 V in response to a direct current input of about 370 V, and includes a control circuit (115 in FIG. 12) and a switching element (transistor, FET, or GTIB) (108 in FIG. 12). The step-down chopper circuit detects an output voltage with resistors 112 and 113 and an output current with a resistor 114, calculates two detection signals with the control circuit 115, and controls on-off of the switching element 118 by output signals of the control circuit 115 such that an output power of the step-down chopper circuit becomes a predetermined value. Usually, an electrolytic capacitor 111 for smoothing voltage having a relatively large capacitance is connected in parallel to an output terminal of the direct current power 103. In the case where alternating current is input, a rectifying and smoothing circuit for rectifying and smoothing the alternating current input and converting it to direct current is added in the previous stage of the step-down chopper circuit.

Figure 13:
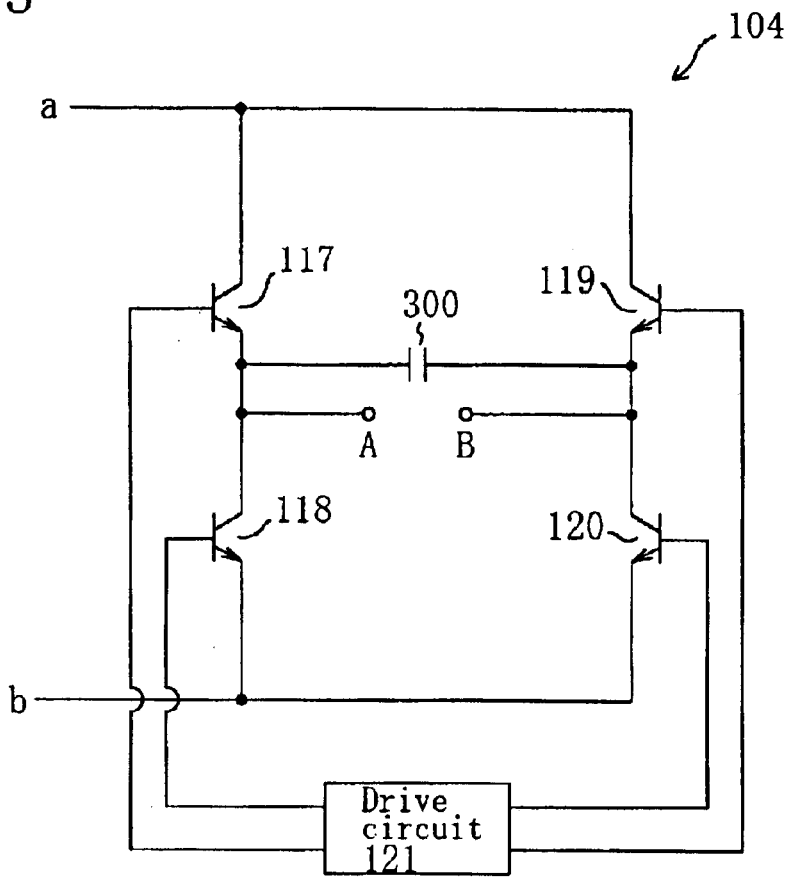
FIG. 13 is a diagram showing a circuit structure of an inverter circuit 104.
Figure 14:
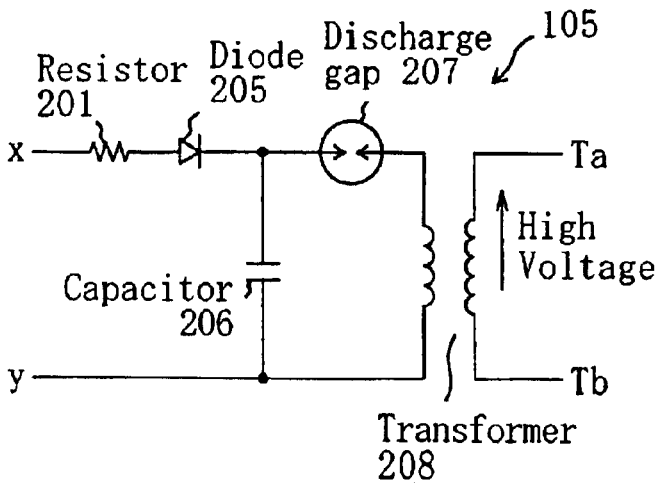
FIG. 14 is a diagram showing a circuit structure of a start circuit 105.

Moreover, the full-bridge inverter circuit constituting the inverter portion 104 includes transistors 117, 118, 119 and 120 and a drive circuit 121, as shown in FIG. 13. In the full-bridge inverter circuit 104, the transistors 117 and 120 and the transistors 118 and 119 are alternately turned on and off by output signals of the drive circuit 121, and thus the output of the step-own chopper circuit is converted to alternating current. One terminal A of the output terminals of the full-bridge inverter circuit 104 is connected to one terminal Tb of a secondary coil (output side coil) constituting the transformer of the start circuit 105. On the other hand, the other terminal B is connected to one end of the lamp via the plug 310 and the pin 311. Moreover, a capacitor 300 is connected in parallel to the both output terminals of the inverter. This capacitor 300 serves to bypass a high voltage pulse generated in the start circuit 105.

Although the start circuit 105 of this embodiment is separated from the substrate of the ballast circuit 1102, a known circuit structure can be used. For example, the structure of the start circuit shown in FIG. 14 can be used. That is to say, the start circuit 105 has the function of generating a high voltage pulse for starting the lamp 101, and the start circuit 105 of the example shown in FIG. 14 includes a transformer 208, a resistor 201, a diode 205, a capacitor 206 and a discharge gap 207. The input terminals thereof are connected to the output terminals of the direct current power 103, and one terminal Tb of the output terminals is connected to the output terminal A of the inverter, and the other terminal Ta is connected to one end of the lamp 101 via the plug 310 and the pin 311, as described above. The discharge gap 207 has the characteristics that it starts discharge at a voltage that is slightly lower than the output voltage of the direct current power 103 and is higher than the voltage of the lamp in operation (for example, about 350 V), and does not cause discharge (or stops discharge) at a voltage lower than that. The discharge gap 207 also has the characteristics that when a pulse voltage of about 350 V (peak value) is applied to a primary coil of the transformer 208, it outputs, for example, a high pulse voltage having a peak value of about 10 kV to 15 kV across both the terminals Ta and Tb of the secondary coil.

In this embodiment, although the start circuit 105 is separated from the substrate of the ballast circuit 1102, the operation of the ballast circuit 1102 of this embodiment is substantially the same as the operation of the ballast circuit 102 shown in FIG. 12 as described above, and thus the description thereof is omitted. However, specific effects that can be obtained by separating the start circuit 105 from the ballast circuit 1102 will be described below.

Figure 2:
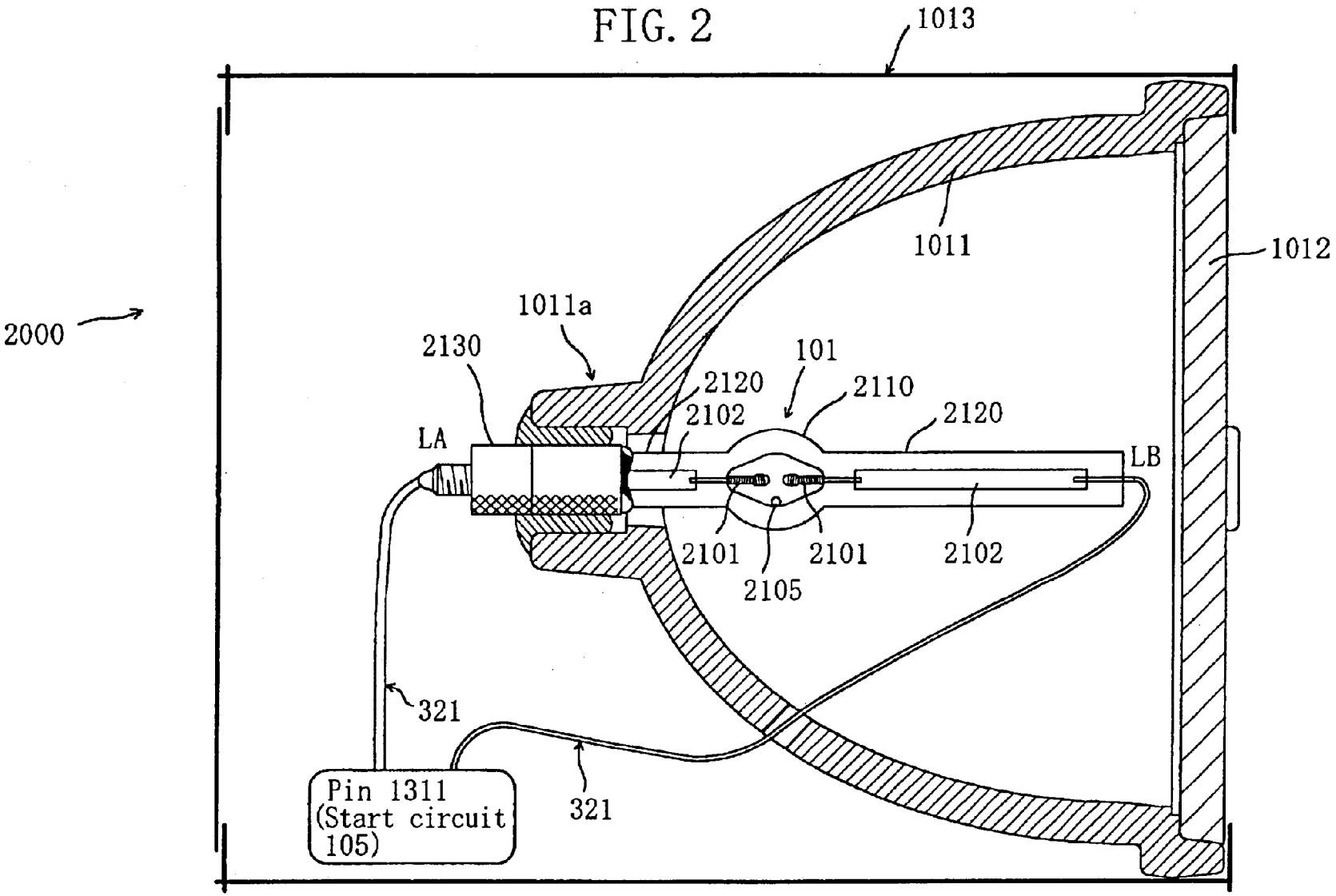
FIG. 2 is a cross-sectional view schematically showing the structure of a lamp unit 2000.

The lamp unit 2000 having the contact (pin) 1311 to be coupled to the contact (plug) 1310 of the ballast circuit 1102 is shown in FIG. 2. As described above, the start circuit 105 is housed in the contact 1311. The lamp unit 2000 has the discharge lamp 101, a reflecting mirror 1011 that reflects light emitted from the discharge lamp 101, and a housing 1013 that holds the lamp provided with the mirror (101 and 1011). The pin 1311 that includes the start circuit 105 inside is connected to the discharge lamp 101 via the high withstand voltage cables 321, and the pin (attachment plug) 1311 is electrically connected to both the lamp 101 and the plug 1310. Thus, a part of the outer surface of the pin 1311 is exposed to the inside of the housing 1013, and another part is exposed to the outside of the housing 1013. It should be noted that the discharge lamp 101 of this embodiment is of alternating current operation type. However, it is possible to operate the lamp 101 even if it is of direct current operation type. In that case, the inverter will be omitted.

The discharge lamp 101 used in this embodiment is a high-pressure mercury lamp and an illustrative structure thereof is as follows. The lamp 101 has a luminous bulb (arc bulb) 2110 in which a luminous material (e.g., mercury) 2105 is enclosed and sealed portions 2120 extending from the both ends of the luminous bulb 2110. The sealed portion 2120 has a metal foil 2102 electrically connected to an electrode 2101 and a glass portion extended from the luminous bulb 2110, and maintains the airtightness in a discharge space of the luminous bulb 2110 by foil sealing of the metal foil 2102 and the glass portion. The glass portion and the luminous bulb 2110 in the sealed portion 2120 are made of, for example, quartz glass. The metal foil 2102 is, for example, a molybdenum foil (Mo foil) and has, for example, a rectangular shape. The sealed portion 2120 is produced, for example, by shrinking and has a substantially circular cross section. The metal foil 2102 is positioned in the central portion of the sealed portion 2120. The metal foil 2102 in the sealed portion 2120 is joined to the electrode 2101 by welding, and the metal foil 2102 has an external lead (corresponding to LA and LB portions) on the side opposite to the side on which the electrode 2101 is joined. The external lead is made of, for example, molybdenum and connected to the metal foil 2102, for example, by welding. A lamp base 2130 is attached to one of the sealed portions 2120, and this portion and the neck portion 1011*a* of the mirror 1011 are secured to each other with, for example, an inorganic adhesive (such as cement) and integrated. The sealed portions 2120 can be also produced by pinching.

An illustrative preferred structure of the lamp 101 is as follows. In order to realize a light source for optical output, it is preferable that the lamp 101 is a mercury lamp with the amount of mercury enclosed being 150 mg/cm$^3$ or more (preferably, 200 mg or more). It is also preferable that the lamp is of 80 W or more. Not only a mercury lamp but also a metal halide lamp can be used. The tube wall load of the lamp 101 is, for example, 60 W/cm$^2$ or more, and there is no particular upper limit. For example, a lamp 101 having a tube wall load in the range from about 60 W/cm$^2$ to about 300 W/cm$^2$ (preferably, about 80 to 200 W/cm$^2$) can be used. If cooling means is provided, a lamp 101 having a tube wall load of about 300 W/cm$^2$ or more also can be used. The rated power of the lamp 101 is, for example, 150 W (in this case, the tube wall load corresponds to about 130 W/cm$^2$). The distance between the electrodes (arc length) of the lamp 101 is, for example, about 0.2 to 5 mm, and is about 1.5 mm in this embodiment. The heads of the electrodes 2101 are wound with coils in order to decrease the temperature at the electrode heads.

Moreover, an illustrative structure of the reflecting mirror 1011 is as follows. The reflecting mirror 1011 is configured so as to reflect radiated light from the lamp 101 in such a manner that the light becomes, for example, a parallel luminous flux, a convergent luminous flux converging on a predetermined small area, or a divergent luminous flux equivalent to that diverged from a predetermined small area As the reflecting mirror 1011, for example, a parabolic mirror or an ellipsoidal mirror can be used. For recent projectors, there is an increasing demand for portability. Thus, there is accordingly a demand for development and commercialization of a compact and thin projector whose size is close to A5 size or B5 size, such as note type personal computers. Under such circumstances, it is preferable to use a more compact reflecting mirror whose opening has a diameter of less than 45 mm. The type of the reflecting mirror that is used preferably has been shifting from the parabolic mirror type emitting parallel light to the ellipsoidal mirror type having a short focal length at which emitted light converges on a certain point (focal point). The reason for this is that the optical path length in the projector is shortened, which can consequently make more contribution to reduction in the size of the projector.

In order to meet the requirements of compactness and the like, the maximum diameter of the reflecting surface of the reflecting mirror 1011 is preferably, for example, less than 40 mm. The typical dimensions of an ellipsoidal mirror type reflecting mirror 1011 are as follows. The diameter of the opening is about 35 mm and the focal length is about 24 mm. A front glass 1012 is provided in the front opening of the reflecting mirror 1011 to prevent scattering in the unlikely event that the lamp is damaged, and the inside of the reflecting mirror 1011 is constituted by an airtight space. The inner volume of the reflecting mirror 1011, namely, the inner volume of the space surrounded by the reflecting mirror 1011 and the front glass 1012 is preferably 200 cm$^3$ or less to meet a requirement of compactness.

The housing (house) 1013 of the lamp housing 2000 is made of, for example, a metal (e.g., aluminum, stainless steel, iron, etc.). Since metal has typically a good thermal conductivity, the heat dissipation of the housing (the lamp provided with the mirror) can be improved. Moreover, in the case of the housing 1013 made of a metal, it is easy to recycle the housing 1013, so that there is also an advantage in that resources can be used effectively. Furthermore, in a structure in which the start circuit 105 is provided in the housing 1013, if the housing 1013 is made of a metal, then also the noise reduction effect can be obtained. As the metal in this case, iron (Fe) is particularly preferable, and those obtained by plating iron with Ni also can be used. The inner volume of the housing 1013 of this embodiment is, for example, about 200 to 2000 $cm^3$.

Figure 3A:
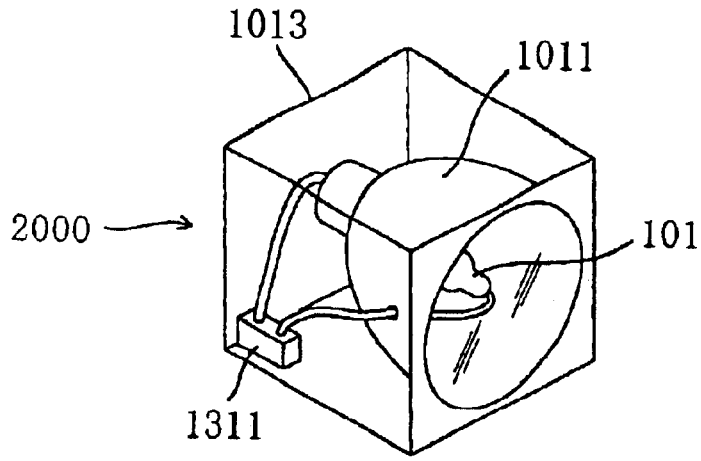
FIG. 3A is a perspective view schematically showing the structure of the lamp unit 2000.
Figure 3B:
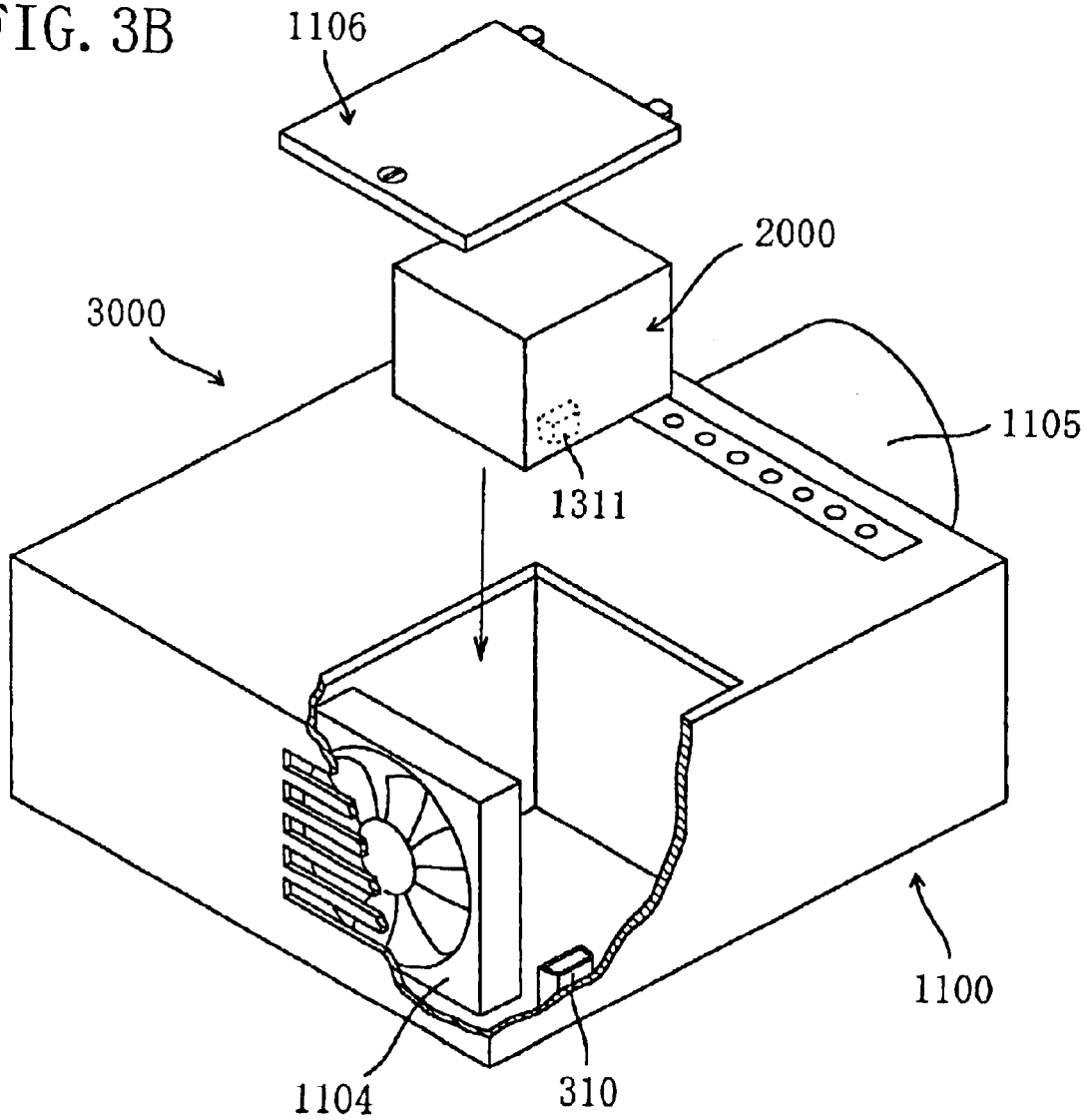
FIG. 3B is a partially cutaway perspective view schematically showing the structure of an image display apparatus 3000.

FIG. 3A shows an appearance of the lamp housing 2000 of this embodiment, and FIG. 3B shows appearances of the projector main body 1100 in which the lamp housing 2000 is to be set and an image display apparatus 3000. In this embodiment, the start circuit 105 is formed in the pin 1311 shown in FIGS. 3A and 3B, and the start circuit 105 is not formed on the substrate for the ballast circuit 1102 provided in the projector main body 1100. Other aspects are substantially the same as those in the structure shown in FIG. 11, so that the same reference numerals are used and the description thereof will be omitted. The image display apparatus 3000 of this embodiment is an image projection apparatus in which the lamp unit 2000 and an optical system including a picture element (such as DMD (Digital Micromirror Device) panel or a liquid crystal panel) are combined. Examples of such an image display apparatus include a projector using DMD (digital light processing (DLP) projector) and a liquid crystal projector (including a reflecting projector employing an LCOS (Liquid Crystal on Silicon) structure).

In this embodiment, the start circuit 105 is separated from the substrate of the ballast circuit 1102 and housed in the lamp unit 1013, so that the following effects can be obtained.

1. Unlike the structure shown in FIG. 12, in the structure of this embodiment, a low voltage wire can be used for wiring between the ballast circuit 1102 excluding the start circuit 105 and the lamp unit 2000. This makes insulation from peripheral equipment easy. In addition, the cost can be reduced because an expensive high voltage wire is not used. Moreover, the high pulse voltage (for starting) is not applied therebetween, so that noise can be decreased.

2. Since the start circuit 105 is housed in the lamp unit 2000, noise from the start circuit 105 can be completely or considerably blocked if the lamp unit 2000 is made of a metallic component (e.g., metal net or the like). Noise also occurs from the portions (e.g., the discharge gap 207) other than the coils (the transformer 208) of the start circuit 105. However, in this embodiment, since the entire start circuit 105 is shielded, effects of noise from the start circuit 105 on the external equipment can be considerably decreased.

3. The noise reduction effect of the above-described advantages 1 and 2 allows the system to start activation even during operation of the start circuit 105. As a result, it is possible to speed up the activation of the system of the projector main body 1100.

Figures 4A, 4B, 4C:
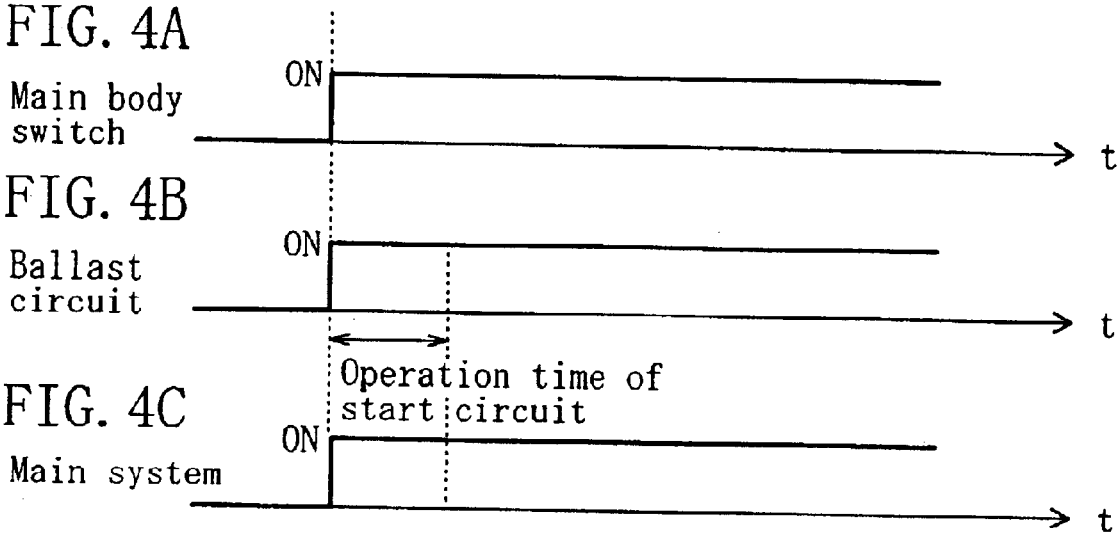
FIGS. 4A through 4C are diagrams showing operation sequences of a main body switch, a ballast circuit and a main system, respectively.
Figures 15A, 15B, 15C, 15D:
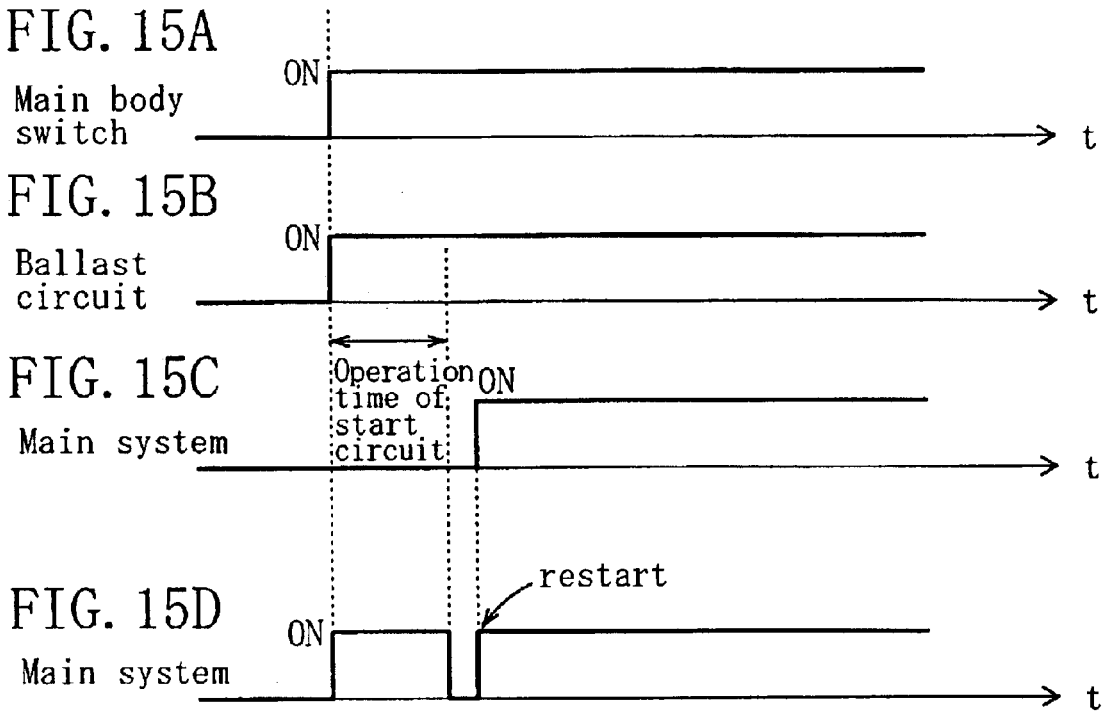
FIGS. 15A through 15D are diagrams showing operation sequences of a main body switch, a ballast circuit, a main system and a main system, respectively.

More specifically, as shown in FIGS. 4A through 4C, when the main body switch (power switch) included in the image display apparatus 3000 is input (FIG. 4A), substantially at the same time, the system (main system) and the ballast circuit can be turned on (FIGS. 4B and 4C). If the ballast circuit is turned on, the start circuit portion 105 operates. However, the system can be activated without problems even in the operation time of the start circuit portion 105 because noise is decreased. Therefore, as shown in FIG. 4C, substantially as soon as the main body switch (power switch) is turned on, the system (in particular, the main system) can be activated. In addition, there is no need to carry out re-activation (restart). That is to say, unlike the conventional operations as in FIGS. 15C and 15D, in this embodiment, it is possible to operate the image display apparatus with a scheme as shown in FIG. 4C. Therefore, the startability can be considerably improved and the possibility that users erroneously take activation delay for malfunction can be considerably reduced. In order to achieve a level at which users do not take it for malfunction, it is more preferable to activate the system, for example, within about one second after the main body switch is turned on, and it is desirable to improve the stability to the operation level of televisions that users are usually familiar with (for example, a level at which the system is activated within about two seconds after the main body switch is turned on). However, if the system is activated within less than 5 seconds after the main body switch is turned on, the startability is improved from that of prior art, and consequently the disadvantage of user taking it for malfunction can be reduced.

4. Since the start circuit can be housed in a dead space in the lamp unit 2000, the size can be reduced by the volume of the start circuit portion (105). The advantage of this reduction in size provided by the structure of this embodiment is particularly large for small projectors of 2 kg or less (the volume is about 3000 cc or less) for which further reduction in size is accompanied with difficulty.

5. Since the start circuit portion 105 that is a high voltage component can be eliminated from the substrate for the ballast circuit, the size of the ballast circuit itself can be also reduced. As a result, the size of the entire apparatus can be further reduced. That is, the absence of the start circuit portion 105 that is a high voltage component makes it unnecessary to provide an insulation distance (insulation distance that has conventionally needed to be provided sufficiently) from the start circuit portion 105, so that size reduction and integration of the other portions becomes easy, and accordingly, further reduction in size can be achieved.

6. Since the distance between the start circuit portion 105 and the lamp 101 is shortened, the attenuation of the start voltage is decreased. Thus, the startability (probability) of the lamp 101 is improved. Moreover, if the same startability is maintained, the transformer 208 with a small step-up ratio can be used, so that the size of the start circuit portion 105 can be reduced. Furthermore, since the use of the transformer with a small step-up ratio means that a cheap electronic component can be used, there is also a great advantage in the cost.

In the image display apparatus 3000 of this embodiment, the start circuit portion 105 is separated from the power circuit portion 103 and the inverter portion 104 of the ballast circuit 1102, so that the size of the ballast circuit 1102 can be reduced by the absence of the start circuit portion 105 in the ballast circuit 1102. Therefore, if the start circuit portion 105 is disposed in the dead space of the image display apparatus 3000, the size of the image display apparatus can be reduced. If the start circuit portion 105 is disposed in the lamp unit 2000, the space in the ballast circuit can be reduced by about 10% and the size of the image display apparatus 3000 can be accordingly reduced.

When the start circuit portion 105 is provided in the position that is closer to the lamp unit 2000 than to the substrate on which the ballast circuit 1102 is formed or in the lamp unit 2000, the distance between the start circuit portion 105 and the lamp 101 can be shortened compared to that of the conventional structure shown in FIG. 12. Therefore, the attenuation of the start voltage is decreased. As a result, the startability (probability) of the lamp 101 is improved. When the start circuit portion 105 is disposed in the lamp housing 1013 and the housing 1013 is provided with a shield (electromagnetic shield) function, noise from the start circuit 105 can be shielded. Thus, the system can be activated even during operation of the start circuit 105, and accordingly, it is possible to speed up the activation of the system of the projector main body 1100. In addition, when producing the start circuit portion 105 so as to also serve as the connector (the pin or the plug), the start circuit portion 105 can be formed with a component of the lamp unit 2000, so that also advantages in designing and manufacturing can be obtained.

In this embodiment, the start circuit 105 is housed in the lamp unit 2000, but is not limited thereto and can be housed anywhere, as long as it is separated from the substrate of the ballast circuit 1102. In other words, it is not only housed in the lamp unit 2000, but also can be disposed on the outer surface of the lamp unit 2000 (the lamp housing 1013) or can be combined with the plug 1310 and disposed in the main body 1100 side, for example. Of course, functions of the start circuit and the contact can be separated. For the purpose of reducing the size of the apparatus, it is sufficient to provide the start circuit 105 in a dead space in the projector main body 1100. However, in order to decrease the attenuation of the start voltage and improve the startability of the lamp 101, it is preferable to dispose the start circuit 105 on the side of the lamp 101 from the mid point between the ballast circuit 1102 and the lamp 101.

In the case where the start circuit 105 is disposed in the main body 1100 side, for example, when it is combined with the plug 1310, the start circuit 105 can remain in the main body 1100 even if the lamp 101 together with the lamp unit 2000 is replaced, so that an advantage of cost efficiency can be obtained. In the case where the start circuit 105 is disposed outside the unit 2000, it is preferable to cover the start circuit portion 105 with a metal case and the like in order to suppress noise. As described above, the pin 311 and the start circuit portion 105 can be separated, and the start circuit portion 105 can be disposed either in the inside, on the inner wall or on the outer wall of the housing 1013, or can be disposed across the wall of the housing 1013. Moreover, the contacts are not limited to a combination of the pin and the plug (i.e., attachment plug and receptacle) that are particularly easily detached and attached, and can be configured by connection with bolts or screw-in or insertion connection, which allow detachment after connection, or connection by attachment under pressure or by compression connection, which does not allow detachment after connection.

In this embodiment, a high voltage side terminal Ta of the secondary coil of the transformer 208 in the start circuit 105 is preferably electrically connected to the external lead (LB) in the sealed portion 2120 that is not secured to the neck portion 1011*a* of the mirror 1011 in FIG. 2. This is because when a high voltage is applied to LA on the secured side, the high pulse voltage leaks to the mirror 1011 easily because the neck portion 1011*a* is close to LA, and as a result, the voltage applied between the heads of the electrodes 2101 of the luminous bulb 2110 is decreased. In fact, when a high voltage was applied to the LA side, in two cases of 50 operation tests, the lamp failed to operate. In contrast, when the same voltage was applied to the LB side of the same lamp (i.e., using the same start circuit), there was no case of 50 operation tests in which the lamp failed to operate. It seems that this is caused by the fact that when a high voltage is applied to LA, the distance between the neck portion 1011*a* and the LA side sealed portion adjacent thereto is small, so that a capacitor with a relatively large capacitance is formed therebetween, and as a result, a high voltage pulse leaks to the mirror 1011 through the capacitor.

Furthermore, the high pulse voltage output from the secondary coil of the transformer 208 in this embodiment has preferably a width (half-width) of 300 nsec or more. With a width of about 50 to 200 nsec, a high pulse voltage having a low peak value of 10 kV to 15 kV was required for starting the lamp. However, by applying a pulse voltage whose width is 300 nsec or more, the lamp can be started with a pulse voltage of about 5 to 9 kV as the peak value, which is lower than the above. The reason for this seems to be as follows when the distance between the electrodes is 0.2 to 5 mm, an electric field application time of 300 nsec or less is not enough to produce a sufficient electron avalanche (breakdown). However, if an application time of 300 nsec or more can be ensured, the electron avalanche can be achieved during that time.

Embodiment 2

Next, an image display apparatus of Embodiment 2 of the present invention will be described with reference to FIGS. 5 and 6.

Figure 5:
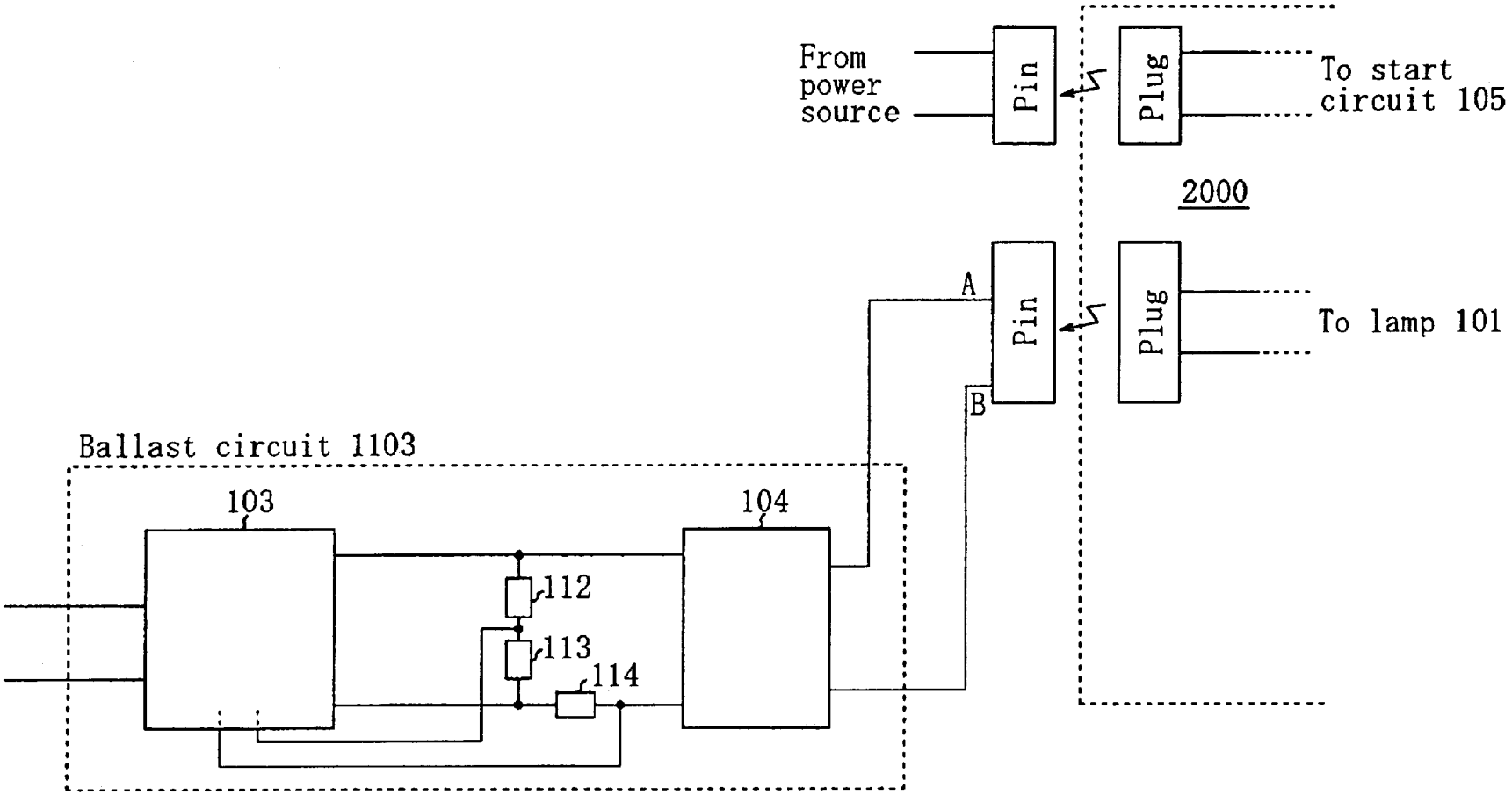
FIG. 5 is a diagram showing a circuit structure of a ballast circuit included in an image display apparatus of Embodiment 2 of the present invention.
Figure 6:
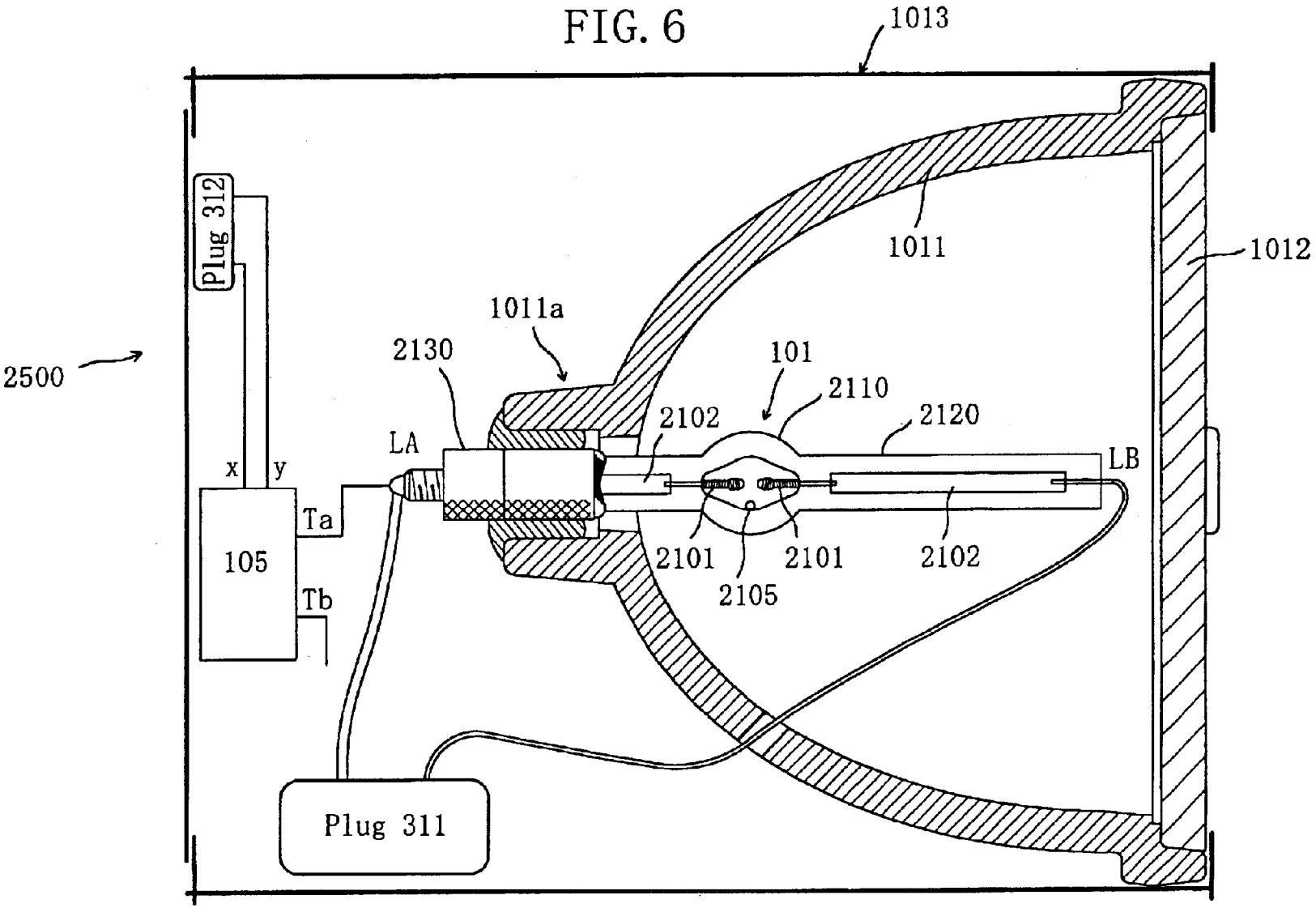
FIG. 6 is a cross-sectional view schematically showing the structure of a lamp unit 2500.

FIG. 5 shows a circuit structure of a ballast circuit 1103 included in the image display apparatus of this embodiment, and FIG. 6 shows a lamp unit 2500 included in the image display apparatus of this embodiment.

The image display apparatus of this embodiment differs from that of Embodiment 1 in the following aspects. As shown in FIGS. 5 and 6, although the start circuit 105 is the same as the structure of Embodiment 1 in the aspect that it is separated from the substrate of the ballast circuit 1103, it has a structure in which lamp current (current after the breakdown) of the lamp 101 does not flow into the secondary coil of the transformer in the start circuit 105. Since other aspects are substantially the same as in the structure of Embodiment 1, description of the same aspects will be omitted or simplified for simplification of description. Hereinafter, the structure of this embodiment will be described further in detail.

The start circuit 105 in this embodiment is separated from the substrate of the ballast circuit 1103 and housed in a lamp unit 1013. In an example shown in FIG. 6, the start circuit 105 has a structure in which the lamp current (i.e., current supplied from the inverter 104) does not flow into the secondary coil of the transformer 208. In this case, the ballast circuit 103 is constituted mainly with the direct current power 103 and the inverter 104. In the examples shown in FIGS. 5 and 6, the contact on the lamp unit 2500 side is the plug and the contact on the main body (1100) side is the pin, but they can be vice versa.

One terminal Ta of the output terminals of the start circuit 105 is connected to one end LA (in the case of the example shown in FIG. 6, a power supply end disposed at the neck portion 1011*a* of the mirror 1011) of the lamp 101, and the other terminal Tb is electrically connected to nowhere and is electrically floating. A voltage is input to the start circuit 105 for a predetermined period (about 1 to 5 seconds), during which the start circuit 105 operates. The input power of the start circuit portion 105 is supplied from another direct current power portion other than the direct current power 103 of the ballast circuit 1103. In addition, output terminals A and B of the inverter 104 is electrically connected to both the ends of the lamp 101.

Next, the image display apparatus of this embodiment, in particular, operations of the ballast circuit 1103 and the start circuit 105 will be described.

First, when the power switch of the image display apparatus is turned on, the ballast circuit 1103 starts operating. At the same time, a voltage is input to the input of the start circuit 105, and the voltage appears at the output terminals Ta and Tb of the start circuit 105 (for example, 5 kV to 20 kV).

Although the output terminal Tb is in the electrically floating state in which it is connected to nowhere, it is substantially in a state of nearly zero potential. Therefore, a voltage corresponding to the potential difference between Ta and Tb and a voltage corresponding to the difference of output voltage (maximum of 370 V) of the inverter (relative to the ground potential) are applied to one terminal LA (and thus to the electrode 2101 connected thereto) of the lamp 101 to which Ta is connected.

On the other hand, since the output terminal of the inverter 104 is connected to the other terminal LB of the lamp 101, a voltage corresponding to the output voltage of the inverter 104 is applied to the end LB of the lamp 101 (and thus to the electrode 2101 connected thereto)

Therefore, in the case where the output voltage of the start circuit 105 is relatively higher than the output voltage of the inverter 104, a voltage close to the output voltage of the start circuit 105 is applied between the electrodes 2101, and this voltage causes breakdown between the electrodes 2101.

After the breakdown, the impedance between the electrodes 2101 is decreased, so that a current flows into therebetween from the inverter 104. Thus, the lamp 101 shifts to arc discharge, and then shifts to ordinary operation.

According to the structure of this embodiment performing such an operation, the following effects can be obtained.

First, in this embodiment, the lamp current does not flow into the transformer in the start circuit 105, so that it is possible to use a thin wire (for example, $\phi$0.2 mm or less) for the winding of the transformer. Actually, in order to cause breakdown in the lamp, it is sufficient to allow a current of several tens mA to several hundreds mA to flow therethrough, so that no particular problem occurs even if a thin wire is used. Therefore, it is possible to achieve considerable reduction in the size of the start circuit 105. For example, the size can be reduced up to about one tenth of the conventional start circuit 105 (i.e., the size as small as one tenth of about 25 cc to about 40 cc). In addition, there is a great advantage of cost reduction due to the reduction in size of the transformer.

The input of the start circuit 105 can be also taken from the output of the direct current power (103) of the ballast circuit 1102. Moreover, if current does not flow between Ta and Tb due to the voltage of the inverter 104, the output terminal Tb of the start circuit 105 can be grounded through a resistor of 1 megaohm or more, for example.

Furthermore, since a current flowing into the transformer in the start circuit 105 is small, it is possible to drive the transformer at high frequency. That is, a high frequency start voltage with short repetition cycles (herein, a high frequency is typically about several tens kHz through 200 to 300 kHz) can be output. If the transformer can be driven at high frequency, a transformer having a small L-value can be used. Therefore, the size of the transformer can be reduced, and thus the size of the start circuit 105 can be further reduced. More specifically, the voltage at both the ends of an inductance is L·(di/dt), where i represents current and t represents time, and therefore L can be a small value to output the same voltage because of the high frequency, that is, the value of di/dt is increased.

Figure 7:
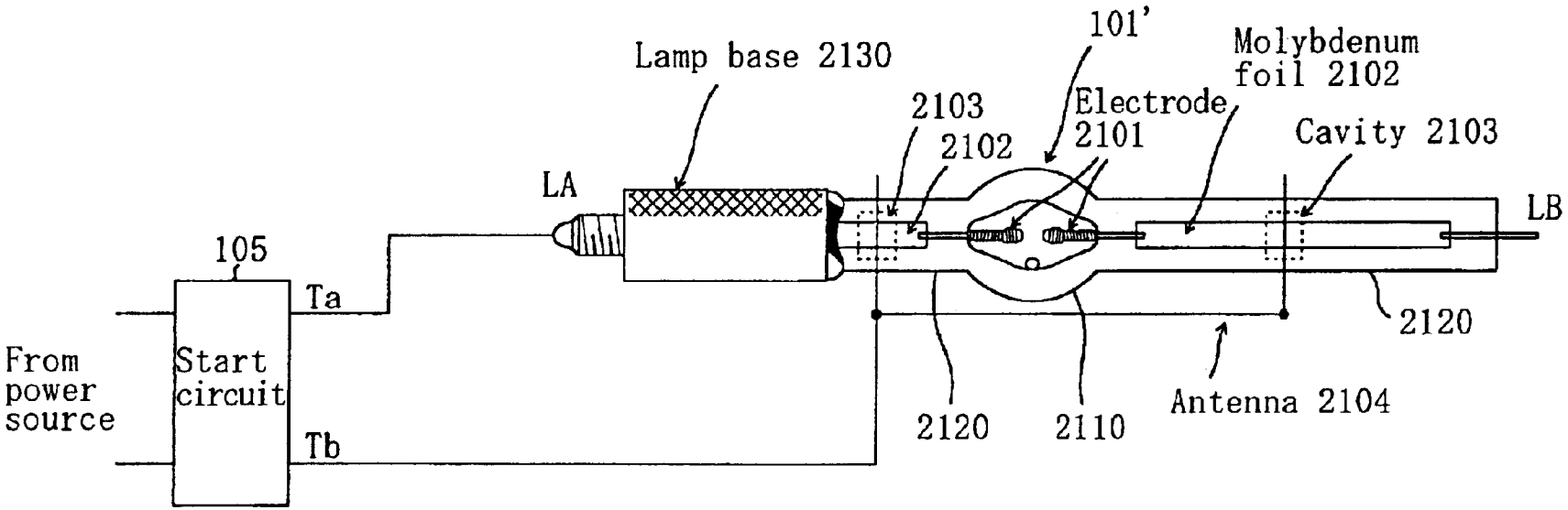
FIG. 7 is a view schematically showing the structure of an example of a combination with a lamp 101' of Embodiment 2.
Figure 8:
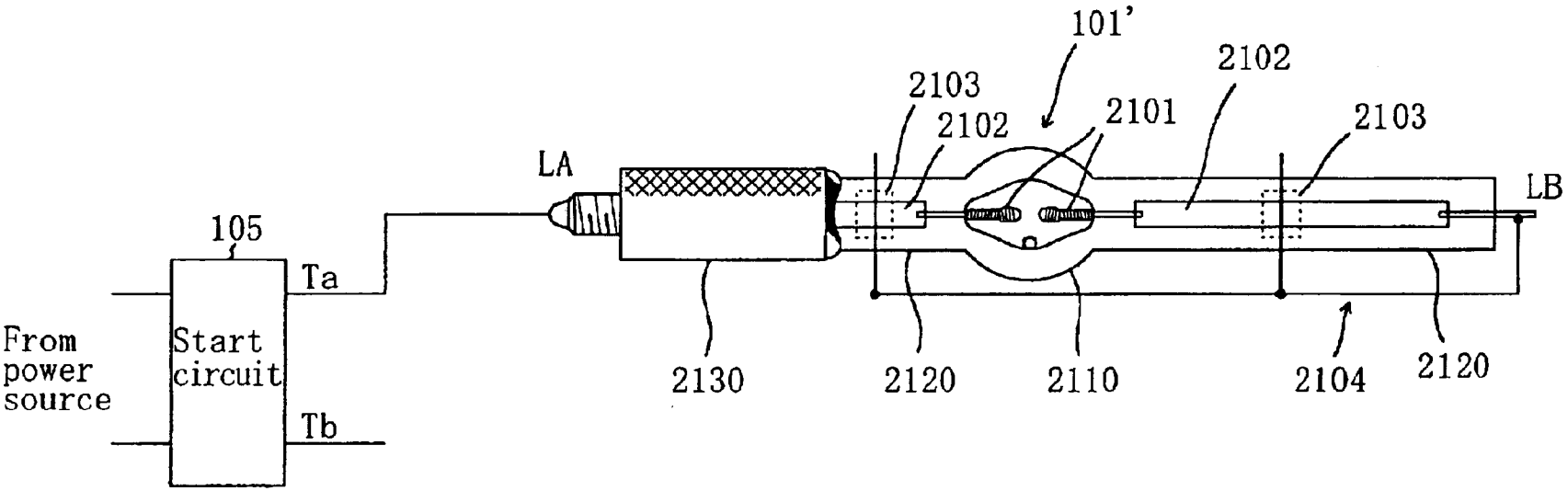
FIG. 8 is a view schematically showing the structure of an example of a combination with a lamp 101' of Embodiment 2.
Figure 9:
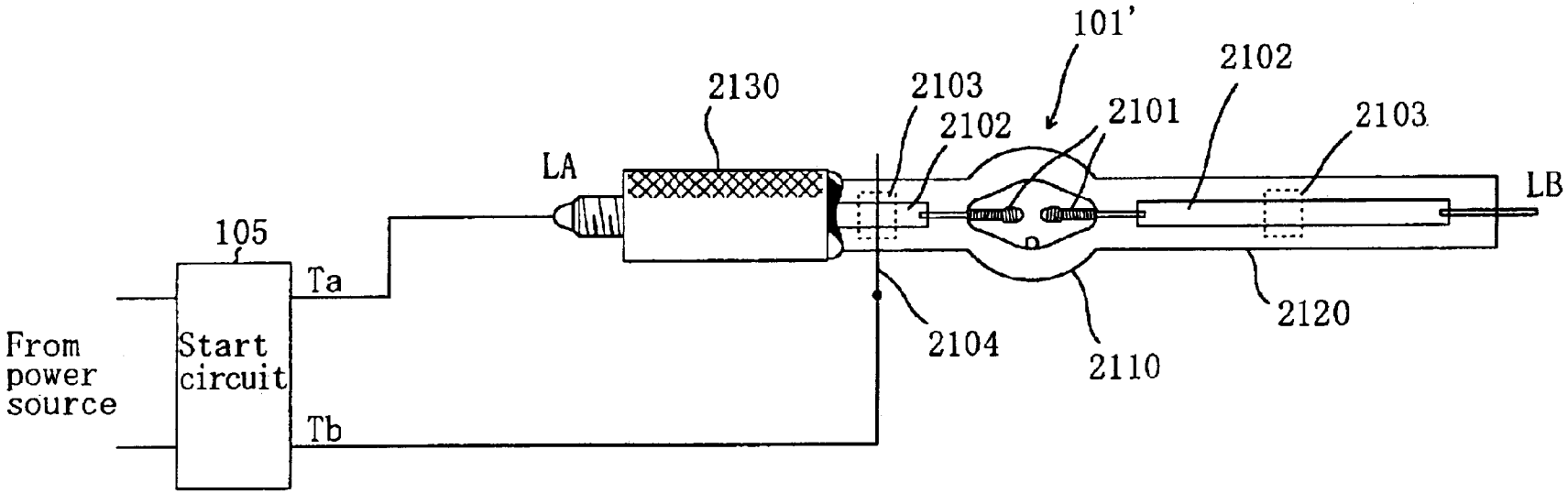
FIG. 9 schematically shows a structure of an example of a combination with a lamp 101' of Embodiment 2.
Figure 10:
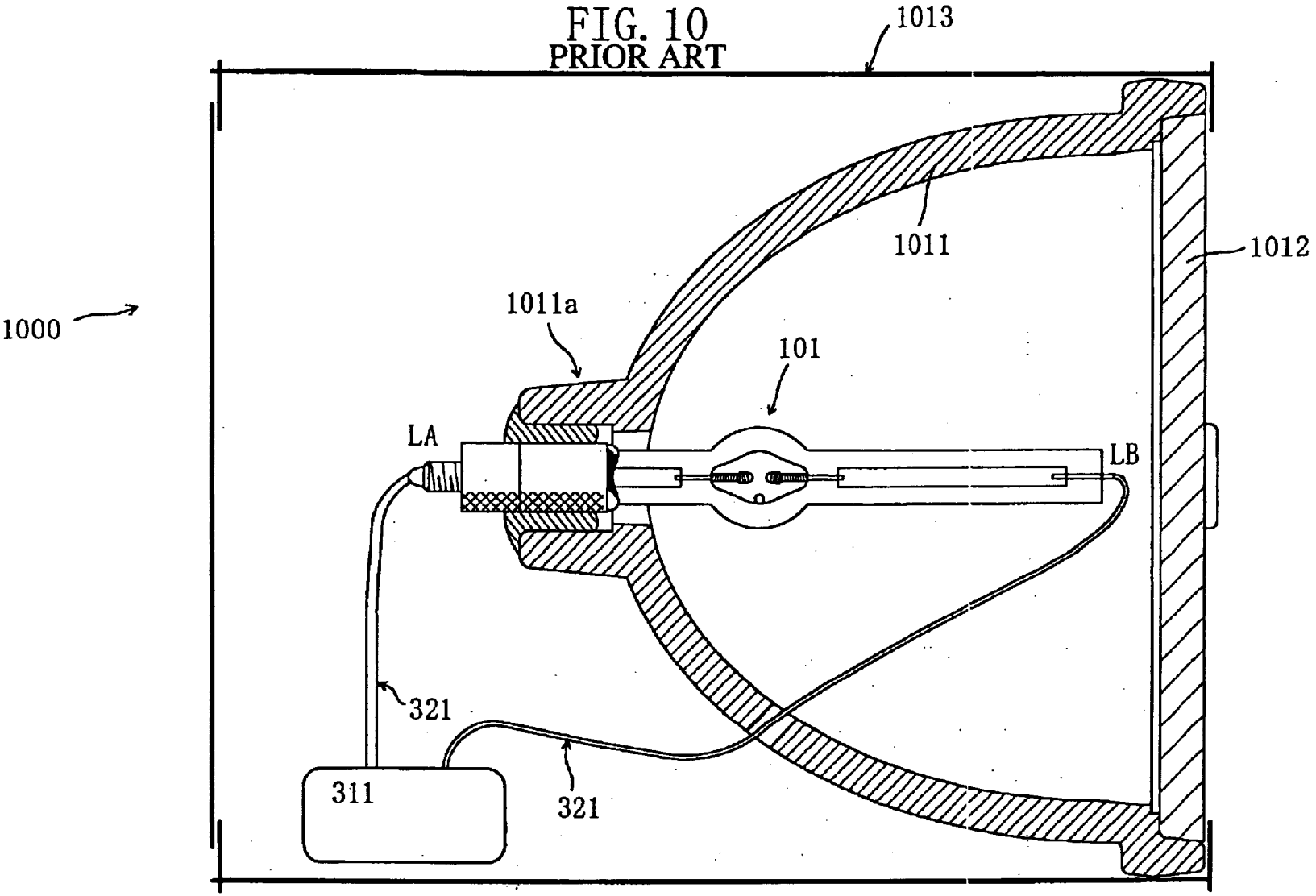
FIG. 10 PRIOR ART
FIG. 10 is a cross-sectional view schematically showing a structure of a conventional lamp unit 1000.
Figure 11A:
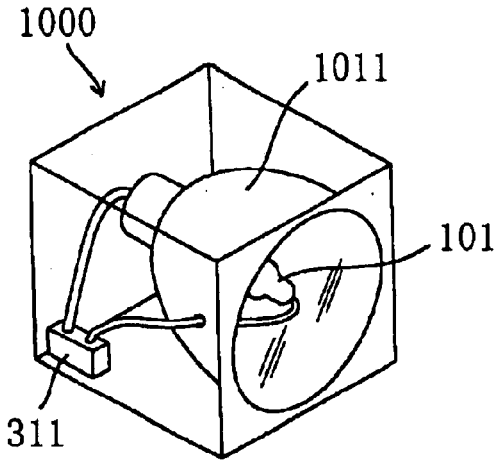
FIG. 11A PRIOR ART
FIG. 11A is a perspective view schematically showing the structure of the conventional lamp unit 1000.
Figure 11B:
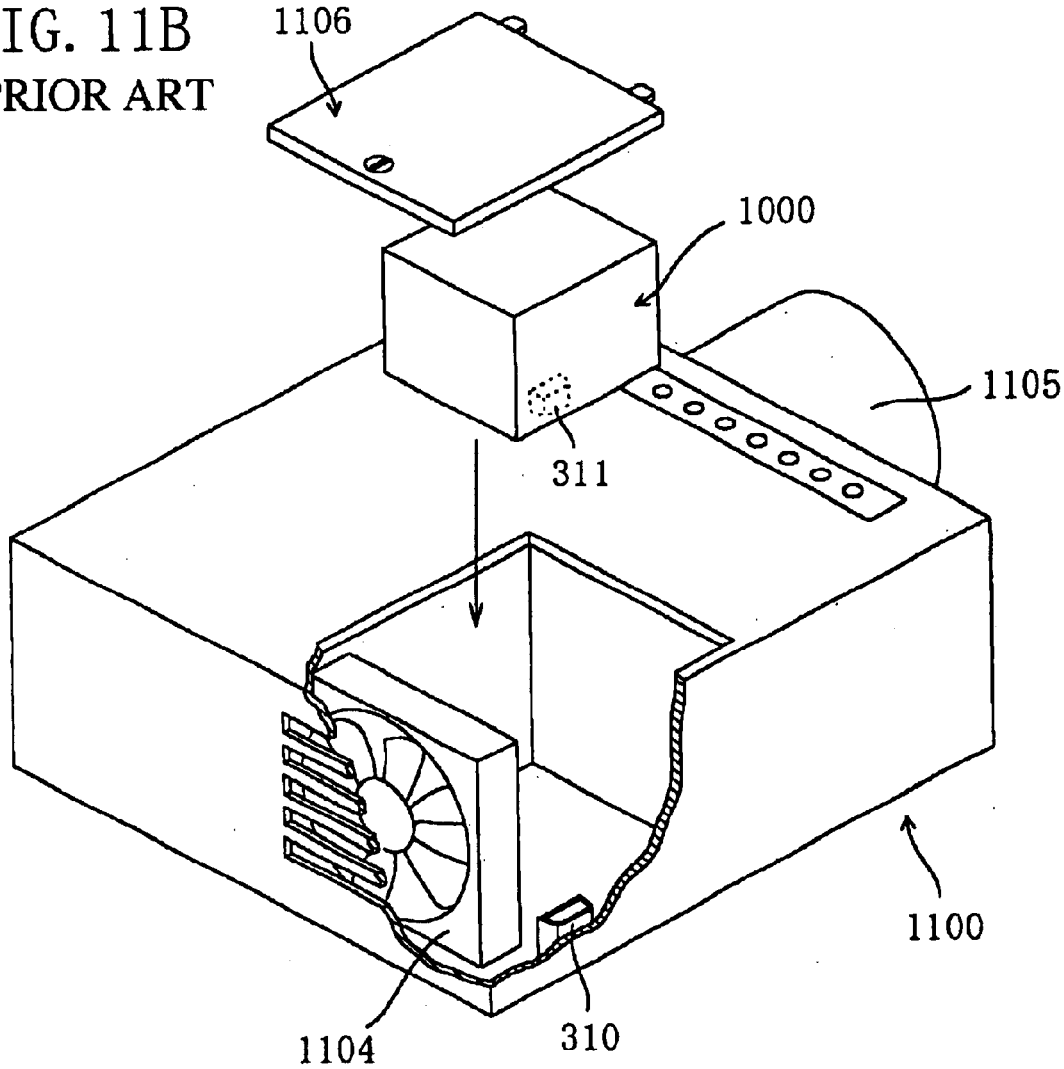
FIG. 11B PRIOR ART
FIG. 11B is a partially cutaway perspective view schematically showing a structure of a conventional projector main body 1100.

Moreover, since a high frequency start voltage can be easily applied from the start circuit, another advantage of facilitating combination with the lamp 101' (low-voltage starting lamp) in which a molybdenum foil portion 2102 is provided with a cavity 2103, as shown in FIGS. 7 through 9, can be provided. The lamp 101' is disclosed in, for example, International Publication No. W00/77826 (International Application No.

PCT/EP00/05579). This international publication is incorporated herein for reference.

Hereinafter, a combination of the ballast circuit 1103 of this embodiment and the lamp unit 2500 including the lamp 101' will be described with reference to FIGS. 7 through 9. However, for simplification of description, only the start circuit 105 and the lamp 101' are shown and other structures (such as the mirror 1011 and the lamp housing 1013) will be omitted as they are the same as the structures shown in FIG. 6.

The lamp 101' has a cavity 2103 in at least one of a pair of the sealed portions, and a rare gas of the same type as that present in the luminous bulb and optionally mercury are enclosed in the cavity 2103. In the center portion of each of the sealed portions, a metal foil (molybdenum foil) 2102 is positioned, and a foil sealing structure is realized by the metal foil 2102 and glass.

FIG. 7 shows a structure in which LA of the lamp 101' and Ta of the start circuit 105 are connected to each other, and an antenna 2104 extended from Tb of the start circuit 105 is provided around (in the vicinity of) the cavities 2103.

FIG. 8 shows a structure in which LA of the lamp 101' and Ta of the start circuit 105 are connected to each other, and the antenna 2104 extended from LB of the lamp 101' is provided around (in the vicinity of) the cavities 2103.

FIG. 9 shows a structure in which LA of the lamp 101' and Ta of the start circuit. 105 are connected to each other, and the antenna 2104 extended from Tb of the start circuit 105 is provided around (in the vicinity of) only one of the cavities 2103.

It should be noted that, in any structure shown in FIGS. 7 through 9, the connections to Ta and to Tb are interchangeable. As described in Embodiment 1, if Ta is connected to LA side, then an advantage of a further improvement of the startability can be obtained.

According to the structures shown in FIGS. 7 through 9, the start voltage is decreased (for example, it is decreased to about 2 kV to 5 kV, and further to 2 kV or less when a high frequency is applied), so that the size of the start circuit 105 (the transformer 208) can be reduced further. A capacitor is formed by the molybdenum foil 2102 in the cavity 2103 and the antenna 2104 provided outside. When a high voltage is applied therebetween, small discharge is effected between the molybdenum foil 2102 and the antenna 2104 (i.e., in the cavity 2103). The light of this discharge travels through the sealed portion 2120 by optical fiber effect and is guided into the luminous bulb 2110, and as a result, electrons are released from the surface of the electrode 2101 and the start voltage is decreased. The impedance of the capacitor is $1/(2\pi fc)$ and is inversely proportional to f. Thus, the leakage to the molybdenum foil 2102 is facilitated by application of a high frequency, and therefore discharge can be effected at an even lower voltage.

Moreover, in the case of the structures shown in FIGS. 7 through 9, even if the lamp is not provided with the cavity 2103 (for example, the lamp 101 shown in FIG. 2), only with the antenna 2104, the electric field distribution can be varied within the luminous bulb 2110, and thus the start voltage can be decreased.

In Embodiments 1 and 2, the start circuit 105 is constituted by the resistor, the capacitor, the discharge gap and the transformer, but the present invention is not limited thereto, and the start circuit 105 can be also constituted by, for example, a push-pull circuit. Also, the transformer is not limited to the transformer composed of coil windings. The transformer can have any structure as long as it can start the lamp and can output a voltage, and for example, a piezoelectric transducer can be used. However, when a high frequency is applied, a transformer with a core is preferred to those with an air-core coil. In the case of the air-core, leaked magnetic flux is large, so that it tends to become a noise source for other components. Moreover, even if the start circuit 105 is provided in the housing 1013 having a noise shielding effect, it is preferable to use a coil with a core than the air-core coil. The reason for this is as follows. In the case of the air-core coil, it is necessary to input a relatively high voltage to the primary coil. Therefore, when the housing 1013 is as small as 200 to 2000 $cm^3$, an insulation structure that is required to prevent leakage of the applied voltage of the primary coil is complicated.

The present invention has been described by preferred embodiments. However, the description as above is not limiting the present invention, but various modifications are possible. In other words, the above-described image display apparatuses and lamp units are only illustrative, and they can be modified. Moreover, the structures of Embodiments 1 and 2 and modifications thereof are applicable to each other, as long as they do not depart from the nature and the spirit of the present invention, and for example, modifications described in Embodiment 1 are applicable to the structure of Embodiment 2.

Some examples of known techniques that have been developed in the structure of the ballast circuit are as follows. Japanese Laid-Open Patent Publication No. 3-136938 discloses a head lamp apparatus in which a start circuit is separated from a power circuit, as a discharge lamp head lamp apparatus for vehicles, though it is not a lamp for a projector. However, a high-pressure discharge lamp (in particular, ultra high-pressure mercury lamp) used for an image display apparatus is not actually used for the head lamp apparatus because, for example, it is too glaring. Moreover, the technique of the embodiments of the present invention associated with the image display apparatus and the technique of this publication associated with the head lamp apparatus are very different from each other in their fields and the problems that occur in respective fields. Therefore, it would be difficult even for those skilled in the art to reach the technique of the embodiments of the present invention based on the technique of this publication.

Japanese Laid-Open Utility Model Publication No. 3-22393 discloses a light source apparatus in which a Tesla coil is provided in a casing having an airtight structure. However, this Tesla coil is a technique for solving problems such as leakage of high voltage caused by making the casing have the airtight structure, and the technical idea is different from that of the technique of the embodiments of the present invention. Thus, it also would be difficult even for those skilled in the art to reach the technique of the embodiments of the present invention based on the technique of this publication.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An image display apparatus comprising:

a lamp unit including a discharge lamp and a reflecting mirror for reflecting light emitted from the discharge lamp;

an optical system having the discharge lamp as a light source; and a ballast circuit for starting and operating the discharge lamp, wherein the ballast circuit includes a power circuit portion, an inverter portion, and a start circuit portion, and the start circuit portion of the ballast circuit is electrically connected to the discharge lamp and is separated from the power circuit portion and the inverter portion; and wherein in the ballast has a structure in which a lamp current supplied from the inverter portion does not flow through a transformer included in the start circuit portion.

2. The image display apparatus according to claim 1, wherein the lamp unit includes the first connector that is electrically connected to the discharge lamp and is coupled to a second connector electrically connected to at least one of the power circuit portion and the inverter portion, in addition to the first and the second connectors, the lamp unit includes a third connector that is electrically connected to the start circuit portion, and the third connector is coupled to a fourth connector that is electrically connected to a power source.

3. The image display apparatus according to claim 1 or 2, wherein a combination of the first connector and the second connector is a combination of an attachment plug and a receptacle, and a combination of the third connector and the fourth connector is a combination of an attachment plug and a receptacle.

4. The image display apparatus according to claim 1, wherein the discharge lamp is a high-pressure mercury lamp.

5. The image display apparatus according to claim 1, comprising a digital micromirror device (DMD) in the optical system.

6. The image display apparatus according to claim 1, wherein the power circuit portion and the inverter portion are formed on a same substrate, and the start circuit portion is not disposed on the substrate and is disposed in a position (including a position in the lamp unit) that is closer to the lamp unit than to the substrate.

7. The image display apparatus according to claim 6, wherein the lamp unit includes a lamp housing for housing the discharge lamp and the reflecting mirror, the lamp housing has a shield function, and the start circuit portion is provided in the lamp housing having the shield function.

8. The image display apparatus according to claim 1, wherein the lamp unit includes a first connector that is electrically connected to the discharge lamp and is coupled to a second connector electrically connected to at least one of the power circuit portion and the inverter portion, and the start circuit portion is provided in the first connector.

9. The image display apparatus according to claim 8, wherein a combination of the first connector and the second connector is a combination of an attachment plug and a receptacle.

10. A method for operating an image display apparatus comprising a lamp unit including a discharge lamp and a reflecting mirror for reflecting light emitted from the discharge lamp; a ballast circuit for starting and operating the discharge lamp; an optical system having the discharge lamp as a light source; and a system for controlling the optical system to display an image, wherein the ballast circuit includes a start circuit portion electrically connected to the discharge lamp, wherein said ballast circuit is configured such that lamp current supplied from the inverter portion does not flow through a transformer included in the start circuit portion; and wherein said method comprises:

activating the start circuit portion of the ballast circuit when a power switch included in the image display apparatus is turned on, and activating the system within an operation time during which the start circuit portion is in operation and a re-activation processing operation is not performed as an activation operation of the system after the operation time is over.

11. The method for operating the image display apparatus according to claim 10, wherein when the power switch is turned on, the start circuit portion of the ballast circuit and the system are activated substantially at the same time, and a time from the turn-on of the power switch to the activation of the system is within about one second.

12. The method for operating the image display apparatus according to claim 11, wherein the image display apparatus includes a digital micromirror device (DMD) in the optical system.

13. A lamp unit used for an image display apparatus including an optical system and a system for controlling the optical system to display an image, comprising;

a discharge lamp;

a reflecting mirror for reflecting light emitted from the discharge lamp; and a lamp housing for housing the discharge lamp and the reflecting mirror, wherein a start circuit portion included in a ballast circuit for starting and operating the discharge lamp is separated from a power circuit portion and an inverter portion included in the ballast circuit and is provided in the lamp housing and wherein the ballast has a structure in which a lamp current supplied from the inverter portion does not flow through a transformer included in the start circuit portion.

14. The lamp unit according to claim 13, wherein the lamp unit includes a first connector that is electrically connected to the discharge lamp and has a structure that can be coupled to a second connector electrically connected to at least one of the power circuit portion and the inverter portion.

15. The lamp unit according to claim 13, wherein the start circuit portion outputs a high voltage pulse for starting the discharge lamp to the discharge lamp during operation of the system.

16. An image display apparatus comprising;

a lamp unit including a discharge lamp and a reflecting mirror for reflecting light emitted from the discharge lamp;

a ballast circuit for starting and operating the discharge lamp;

an optical system having the discharge lamp as a light source; and a system for controlling the optical system to display an image, wherein the ballast circuit includes a power circuit portion, an inverter portion, and a start circuit portion, the start circuit portion of the ballast circuit is electrically connected to the discharge lamp and is separated from the power circuit portion and the inverter portion, the start circuit portion of the ballast circuit is activated when a power switch included in the image display apparatus is turned on, and the system is activated within an operation time during which the start circuit portion is in operation and a re-activation processing operation of the system is not performed as an activation operation of the system after the operation time is over; and wherein the ballast has a structure in which a lamp current supplied from the inverter portion does not flow through a transformer included in the start circuit portion.

* * * * *